US011332883B2

(12) United States Patent
Luo et al.

(10) Patent No.: US 11,332,883 B2
(45) Date of Patent: May 17, 2022

(54) TREATED KRAFT PULP COMPOSITIONS AND METHODS OF MAKING THE SAME

(71) Applicant: International Paper Company, Memphis, TN (US)

(72) Inventors: Mengkui Luo, Auburn, WA (US); Venketa Ranganathan Parthasarathy, Pooler, GA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/236,093

(22) Filed: Dec. 28, 2018

(65) Prior Publication Data

US 2019/0242060 A1 Aug. 8, 2019

Related U.S. Application Data

(63) Continuation of application No. 14/145,535, filed on Dec. 31, 2013, now abandoned.

(51) Int. Cl.

| | |
|---|---|
| ***D21H 13/08*** | (2006.01) |
| ***D21H 11/04*** | (2006.01) |
| ***D21C 9/14*** | (2006.01) |

(52) U.S. Cl.

CPC ..... *D21C 9/144* (2013.01); *D21H 11/04* (2013.01); *D21H 13/08* (2013.01)

(58) Field of Classification Search

CPC ..... D21H 17/25; D21H 17/14; D21H 5/148

See application file for complete search history.

(56) References Cited

U.S. PATENT DOCUMENTS

| | | | |
|---|---|---|---|
| 3,617,439 | A | 11/1971 | Chapman, Jr. |
| 6,210,801 | B1 | 4/2001 | Luo et al. |
| 6,331,354 | B1 | 12/2001 | Sealey et al. |
| 6,491,788 | B2 | 12/2002 | Sealey et al. |
| 6,686,039 | B2 | 2/2004 | Sealey et al. |
| 6,776,876 | B1 | 8/2004 | Vuorinen et al. |
| 6,833,187 | B2 | 12/2004 | Luo et al. |
| 7,390,566 | B2 | 6/2008 | Luo et al. |
| 9,447,540 | B2 | 9/2016 | Heiskanen |
| 2006/0223992 | A1 | 10/2006 | Luo et al. |
| 2008/0160514 | A1 | 7/2008 | Sealey et al. |
| 2009/0165969 | A1 | 7/2009 | Luo |
| 2009/0312536 | A1 | 12/2009 | Sixta et al. |

(Continued)

FOREIGN PATENT DOCUMENTS

| | | | |
|---|---|---|---|
| CA | 2160430 | C | 12/2004 |
| CN | 1168706 | A | 12/1997 |

(Continued)

OTHER PUBLICATIONS

Ostgerg et al.,Some Aspects of the Reactivity of Pulp Intended for High-Viscosity Viscose, 2012, BioResources, 7(1), p. 743-755. (Year: 2012).*

(Continued)

*Primary Examiner* — Anthony Calandra
(74) *Attorney, Agent, or Firm* — Thomas W. Barnes, III

(57) ABSTRACT

Compositions including treated Kraft pulp, useful for making rayon fibers, having a lower degree of polymerization, a high R18, a low hemicellulose content, and high reactivity, are described. Methods of making the compositions are also described.

19 Claims, 6 Drawing Sheets

(56) References Cited

U.S. PATENT DOCUMENTS

| | | | |
|---|---|---|---|
| 2009/0321025 | A1 | 12/2009 | Weightman |
| 2010/0162541 | A1 | 7/2010 | Luo et al. |

FOREIGN PATENT DOCUMENTS

| | | | |
|---|---|---|---|
| CN | 1247250 | A | 3/2000 |
| CN | 1517490 | A | 8/2004 |
| CN | 101275293 | B | 10/2008 |
| CN | 102174753 | A | 9/2011 |
| EP | 2 325 246 | A2 | 5/2011 |
| WO | 2013/004909 | A1 | 1/2013 |

OTHER PUBLICATIONS

English language abstracts for CN102174753 and CN1247250 c(cited without translation in IDS), translate Jan. 2022. (Year: 2022).*

Bapjpai, P., and P.K. Bajpait, "Development of a Process for the Production of Dissolving Kraft Pulp Using Xylanase Enzyme," Appita Journal 54(4):381-384, 2001.

Ek, M., et al., "Increased Reactivity of Dissolving Pulps by Different Pretreatments," Ninth European Workshop on Lignocellulosics and Pulp, Vienna, Aug. 27-30, 2006, pp. 106-108.

Engström, A.C., et al., "Improved Accessibility and Reactivity of Dissolving Pulp for the Viscose Process: Pretreatment With Monocomponent Endogluconase," Biomacromolecules 7(6):2027-2031, Jun. 2006.

Fischer, K., et al., "Reactivity of Dissolving Pulp for Processing Viscose," Macromolecular Symposia 280(1):54-59, 2009.

Gehmayr, V., et al., "A Precise Study on the Feasibility of Enzyme Treatments of a Kraft Pulp for Viscose Application," Cellulose 18(2):479-491, 2011.

Gehmayr, V., and H. Sixta, "Dissolving Pulps from Enzyme Treated Kraft Pulps for Viscose Application," Lenzinger Berichte 89:152-160, 2011.

Köpcke, V., et al., "Feasibility Study on Converting Paper-Grade Pulps to Dissolving-Grade Pulps," 11th European Workshop on Lignocellulosics and Pulp (EWLP), Aug. 16-19, 2010, Hamburg, pp. 149-152.

Kvarnlöf, N., et al., "Modification of the Viscose Process to Suit the Use of dissolving Pulps Pre-Treated With Enzyme," Paperi ja Puu 90(4):50-55, 2008.

Notification of First Office Action dated May 9, 2016, issued in Chinese Patent Application No. 201410853238, filed Dec. 31, 2014, 11 pages.

Östberg, L., et al., "Some Aspects of the Reactivity of Pulp Intended for High-Viscosity Viscose," BioResources 7(1):743-755, 2012.

Östberg, L., and U. Germgard, "Some Aspects on the Activation of Dissolving Pulps and the Influence on the Reactivity in a Following Viscose Stage," Cellulose Chemistry and Technology 47(3-4):165-169, 2013.

Smook, G.A., "Handbook for Pulp and Paper Technologists," 1992, Angus Wilde Publications, 2d ed., Chapter 2.

Smook, G.A., "Handbook for Pulp and Paper Technologists," 1992, Angus Wilde Publications, 2d ed., Chapter 4.

Strunk, P., et al., "Chemical Changes of Cellulosic Pulps in the Processing to Viscose Dope," Cellulose Chemistry and Technology 46(9-10):559-569, 2012.

Notification of Second Office Action dated Aug. 24, 2020, in Chinese Patent Application No. 201710963012.8, filed Dec. 31, 2014, 30 pages.

Notification of First Office Action dated Sep. 26, 2019, issued in Chinese Patent Application No. 201710963012.8, filed Dec. 31, 2014, 20 pages.

* cited by examiner

TREATED KRAFT PULP COMPOSITIONS AND METHODS OF MAKING THE SAME

CROSS-REFERENCE TO RELATED APPLICATION

The present application is a continuation of U.S. application Ser. No. 14/145,535, filed on Dec. 31, 2013, the entire content of which is hereby incorporated by reference in its entirety.

FIELD OF THE INVENTION

The present invention provides treated Kraft pulp compositions, blends including the treated Kraft pulp compositions, methods of making the treated Kraft pulp compositions and blends, and fibers and nonwoven materials made from the compositions.

BACKGROUND

Cellulose is a polymer of D-glucose and is a structural component of plant cell walls. Cellulose is especially abundant in tree trunks from which it is extracted, converted into pulp, and thereafter utilized to manufacture a variety of products. Rayon is the name given to a fibrous form of regenerated cellulose that is extensively used in the textile industry to manufacture articles of clothing and nonwoven materials. In one process of producing rayon, the viscose process, cellulose is first steeped in a mercerizing strength caustic soda solution to form an alkali cellulose. This is reacted with carbon disulfide to form cellulose xanthate which is then dissolved in dilute caustic soda solution. After filtration and deaeration the xanthate solution is extruded from submerged spinnerets having a plurality of small holes into a regenerating bath of sulfuric acid, sodium sulfate, and zinc sulfate (or aluminum sulfate), to form continuous filaments which can be cut into staple fibers or used as continuous yarns. The resulting so-called viscose rayon is suitable for use in textiles and nonwoven materials, and has also been used for reinforcing rubber articles such as tires and drive belts.

Rayon fibers can be produced from high quality wood pulps that have been extensively processed to remove non-cellulose components, especially lignin and hemicellulose. These highly processed pulps are referred to as dissolving grade or high alpha (or high a) pulps, where the term alpha refers to the percentage of cellulose. Thus, a high alpha pulp contains a high percentage of cellulose, and a correspondingly low percentage of other components, especially lignin and hemicellulose. The processing required to generate a high alpha pulp significantly adds to the cost of rayon fibers and products manufactured therefrom.

A need exists for pulp compositions having the advantageous properties of high alpha pulp compositions without the associated costs of such a highly processed pulp. The present invention seeks to fulfill this need and provides further related advantages.

SUMMARY

The present invention provides treated Kraft pulps having an increased reactivity, natural cellulose I structure, relatively high xylan content (between 4.7% to 8%), relatively high total hemicellulose content, low viscosity (<12 cP capillary viscosity), and high R18 (>88%). The treated Kraft pulp can act as a pulp extender, such as by being blended with dissolving grade pulp in viscose applications, thus increasing the yield and decreasing the cost of viscose production (such as by reducing the amount of the high-cost dissolving grade pulp used).

In one aspect, the invention provides a treated Kraft pulp, having a hemicellulose content of 5% or more and a R18 value of 88% or more. The treated pulp is reactive, as measured by at least one reactivity value selected from a standard reactivity of 3.5 mL or more, a modified reactivity of 30 mL or more, a filter value $K_r$ of 10,000 or less, a SEM fiber segment count of 11 segments or less per 100 $\mu m^2$ of a filter when the pulp is subjected to a modified reactivity test, and a crystallite cross-section of less than 20.6 $nm^2$. The treated pulp has less than 8% by weight of cellulose II as determined by x-ray crystallography.

In another aspect, the invention provides a pulp blend that includes a treated pulp, a dissolving pulp having a R18 of greater than 92%, and has a total xylan and mannan content of 6% or more.

In a further aspect, the invention provides a rayon fiber produced from the pulp blend of the invention.

Aspects and/or embodiments of the invention include one or more of the following features. In some embodiments, the hemicellulose content of the treated pulp is greater than 7%. The R18 value of the treated pulp can be from 88% to 92%. The treated pulp can include a pentosan content of from 4.6% to 9%. The treated pulp can further include a xylan content of 4% to 8%. The treated pulp can further include a mannan content of 3% to 8%.

In some embodiments, the treated pulp includes a standard reactivity of 5 mL or more. The treated pulp can include a modified reactivity of 50 mL or more. The treated pulp can include a filter value $K_r$ of 8,000 or less.

The treated pulp can include a carboxyl content of less than 3.6 milli-equivalent ("meq")/100 g, an ASTM degree of polymerization ("DP") of from 600 to 900, and/or a copper number of from 0.3 to 1.2. The treated pulp can have as little as 0% detectable cellulose II as determined by x ray crystallography.

In some embodiments, the blend further includes a surfactant (e.g., a non-ionic surfactant, for example, Berol). The blend can include at least 20% by weight of the treated pulp (e.g., at least 30% by weight of the treated pulp).

In some embodiments, the blend has a filter value $K_r$ of 15,000 or less (e.g., a filter value $K_r$ of 10,000 or less, or a filter value $K_r$ of from 3000 to 9000). The blend can have a gamma number of 45.1% or more (e.g., a gamma number of 46% or more, or a gamma number of 47% or more).

In some embodiments, the treated pulp has an ageing time of 50 hours or less to reach a target Cuox DP of 340.

In some embodiments, the rayon fiber produced from such a blend has a hemicellulose content of from 2% to 5%.

In another aspect, the invention provides a method of making a treated pulp that includes several stages. In one embodiment, the method includes exposing a pulp (e.g., a wood pulp) to an oxygen bleaching stage to provide a first delignified pulp; exposing the first delignified pulp a first chlorine dioxide bleaching stage to provide a second delignified pulp, exposing the second delignified pulp to a lignin extraction stage to provide an extracted pulp; and exposing the extracted pulp to a second chlorine dioxide bleaching stage to provide a treated pulp. In one embodiment, the stages occur in sequence. In certain embodiments, the method further includes at least one of an acid treatment stage and/or an enzyme treatment stage, each of the acid treatment stage and the enzyme treatment stage occurring between the oxygen bleaching stage and the first chlorine dioxide bleaching stage, between the lignin extraction stage and the second chlorine dioxide bleaching stage, or after the second chlorine dioxide stage.

In some embodiments of a method of making a treated fiber, an acid treatment step includes using an acid selected from hydrochloric acid, phosphoric acid, sulfuric acid, acetic acid, and/or nitric acid. The enzyme treatment step can include using an enzyme selected from xylanase, laccase, pectinase, lipase, peroxidase, mannanase, cellulase, and/or any combinations thereof.

In some embodiments, the method further includes a viscosity lowering step, such as cooking a wood chip to low kappa from 10 to 20, delignifying a cooked pulp to kappa from 3 to 10, bleaching a brownstock at a delignification stage, oxidation using a TEMPO catalyst, oxidation using hypochlorite, and/or oxidation using chlorine oxide under alkaline condition, or peracetic acid (peracid), or any combinations thereof.

The concepts, features, methods, and embodiments briefly described above are clarified with reference to the accompanying drawings and detailed description below.

DETAILED DESCRIPTION

Figure 1:
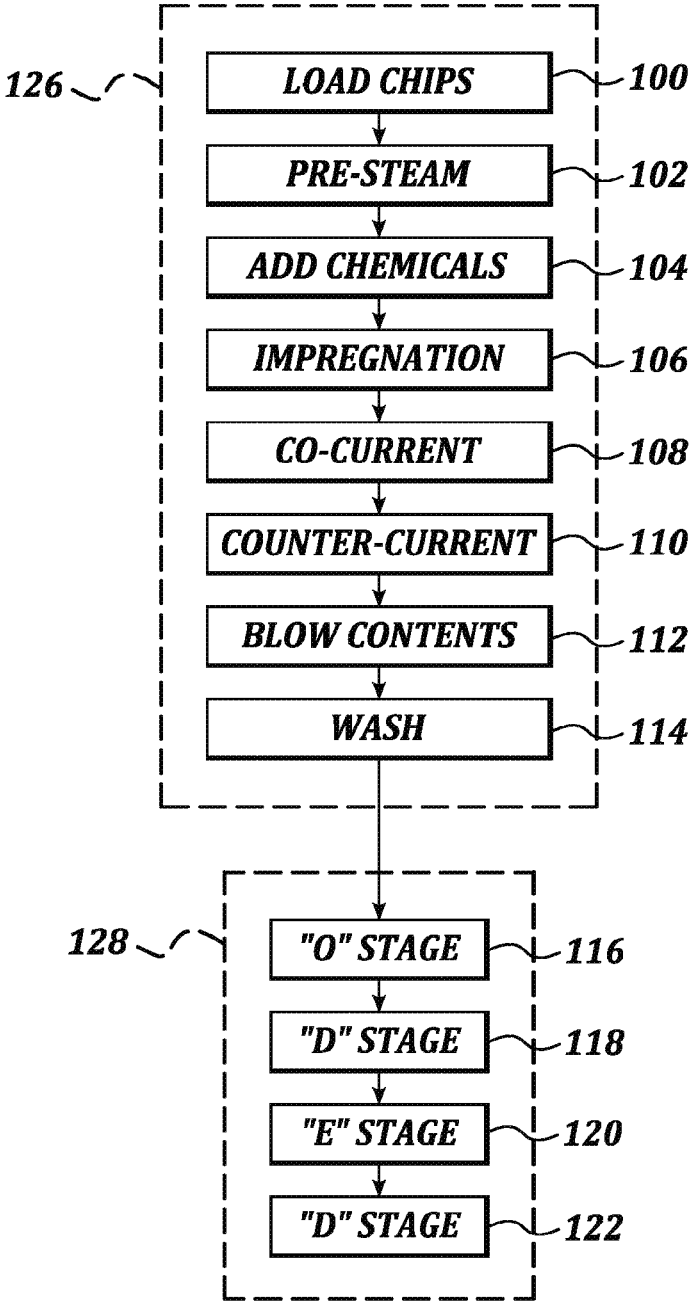
FIG. 1 is flow chart illustrating a representative method of the invention for making a pulp.

The present invention provides treated pulp compositions, blends including the treated pulp compositions, methods of making the treated pulp compositions and blends, and fibers and nonwoven materials made from the compositions.

The treated pulps produced in accordance with the present disclosure exhibit increased reactivity, natural cellulose I structure, relatively high xylan content, relatively high total hemicellulose content, low viscosity, and high R18. The treated pulp can act as a pulp extender, for example by being blended with dissolving pulp in viscose applications, thereby increasing the yield, decreasing the cost of viscose production (such as by reducing the amount of high cost dissolving grade pulp used in such applications).

The treated pulp, when used as a pulp extender, has utility in a variety of applications. Further advantages of the treated pulp of the invention are described below.

Dissolving pulp is a high-grade cellulose pulp, with low contents of hemicellulose, lignin and resin. This clean pulp can be used as a raw material for different kinds of cellulose products, such as rayon and viscose. Generally, dissolving pulps have low hemicellulose content (e.g., less than 3%) and low alkali solubility (e.g., having a R18 value that is greater than 94%). However, such a pulp results in decreased overall utilization of wood components, in particular hemicellulose, and can increase production costs for rayon, ether and ester cellulose derivatives, microcrystalline cellulose, and lyocell.

To decrease costs for rayon applications and increase utilization of hemicellulose, a wood pulp that has been treated by a Kraft process (a "Kraft pulp") can serve as a dissolving pulp extender ("pulp extender") that is blended with dissolving pulps to produce rayon fibers. In such an application, a pulp extender should have a high blending ratio with dissolving wood pulp, a high rayon yield, and a steeping rate matching that of dissolving pulp in a blend. The pulp extender should have characteristics that, in the range of economically attractive operating conditions, allows a dope (i.e., the solution of treated pulp from which rayon fibers are produced) to be readily aged to a target viscosity, xanthated, then extruded through the narrow orifices of a spinneret utilized to form rayon fibers. For example, the extender should possess sufficient DP and viscosity to allow xanthation and extrusion, yet not so low of a DP and viscosity such that the steeping process is negatively affected by too many low viscosity molecules or such that the strength of the resulting rayon fibers is substantially compromised.

Thus, the treated pulp of the invention, being a high yield, low cost softwood or hardwood pulp that has been treated with a modified Kraft process ("a treated pulp"), having a natural cellulose I structure, a high xylan content of between 4.7% to 8%, a high total hemicellulose content, a low capillary viscosity of less than 12 cP capillary viscosity, a high R18 of greater than 88%, and improved reactivity over traditional dissolving pulps, can be used as a pulp extender and can provide more expanded viscose rayon, lyocell, cellulose derivatives (ethers, esters), microcrystalline cellulose applications. The treated pulp can provide significantly more economic benefits for the production of rayon fibers, because such a treated pulp can maximize utilization of wood components (e.g., hemicellulose), thus resulting in higher yield. When blended as a pulp extender with dissolving pulp, the treated pulp can match steeping rate/process conditions of the dissolving pulp, and the resulting blend can have fewer dope filterability issues, resulting in fewer filter changes, less waste dope, and higher rayon/viscose productivity. Furthermore, the latewood content in a treated Kraft pulp can be important, as less latewood in the pulp (e.g., more earlywood content in the pulp, or more thinnings to make the pulp) can provide for better reactivity.

Definitions

As used herein, the reactivity of a pulp refers to the capacity of cellulose fibers in a pulp to participate in diverse chemical reactions, such as formation of ethers and esters (e.g., xanthates, acetates, and methyl ethers). Reactivity is related to the accessibility of the cellulose for the chemicals to be used. The hydrogen bonds between cellulose polymers and between microfibrils in a pulp can play important roles in the accessibility. In general, accessibility is higher in the hydrogen networks of cellulose I than II, which have different crystalline structures. Reactivity is affected by hornification.

As used herein, hornification refers to the stiffening of the polymer structure that takes place in pulps upon drying or water removal. Hornification reduces reactivity.

As used herein, viscosity is related to the length of the cellulose chains and can be measured in different solvents.

As used herein, alkali resistance indicates the fraction of the pulp that is insoluble in sodium hydroxide at different sodium hydroxide concentrations.

As used herein, R18 refers to the alkali resistance of cellulose materials tested in 18% NaOH solution at a retention time of 1 hour at 20° C. The values from R18 measurements refer to the amount of the cellulose material that is not dissolved in the NaOH solution. Thus, a higher R18 indicates greater alkali resistance and lower alkali solubility. Generally, the hemicellulose is soluble in 18% NaOH. However, for pulps with low DP, both the low molecular weight cellulose and the hemicellulose are dissolved in 18% NaOH.

As used herein, R10 refers to the alkali resistance of cellulose in 10% NaOH. A higher R10 indicates lower alkali solubility. In general, both low molecular weight cellulose and hemicellulose are dissolved in 10% NaOH.

As used herein, Cuox refers to a cellulose solvent: cuprammonium hydroxide, also referred to as Schweitzer's reagent.

As used herein, kappa refers to the kappa number, which is an indication of the residual lignin content or bleachability of wood pulp by a standardized analysis method. The kappa number is a measurement of standard potassium permanganate solution that the pulp will consume.

As used herein, brownstock refers to a wood fiber in water suspension that occurs after chips or cut plant material breaks down into a thick porridge-like consistency and is "blown" or squeezed from the outlet of a digester through an airlock.

As used herein, earlywood refers to the part of a growth ring nearest the center of the tree, and formed early in the growing season when growth is rapid, usually composed of wider elements and usually lighter in color than that near the outer portion of the ring.

As used herein, latewood refers to the outer portion of the ring formed later in the season, usually harder and less porous than earlywood.

As used herein, hemicellulose content refers to a sum of xylan and mannan percentages.

As used herein, gamma number is defined as the number of xanthate groups per 100 anhydroglucose units in a cellulose composition. The theoretical maximum esterification corresponds to a gamma number of 300%, where the degree of substitution is 3 per anhydroglucose in cellulose. A higher gamma number reflects the dissolution ability of a pulp in viscose preparation. A higher gamma number also means that coagulation time in the spinning process is prolonged, which is beneficial as it can increase the strength of the viscose fibers.

As used herein, ash refers to the residue left after combustion of wood and is related to a wood mineral content.

As used herein, $K_w$ refers to a filter value, as discussed, for example, in U.S. Pat. No. 7,390,566, incorporated herein by reference in its entirety.

As used herein, $K_r$ refers to filter value, which is a viscosity-corrected $K_w$ value and is calculated from $K_w$, as discussed, for example, in U.S. Pat. No. 7,390,566, incorporated herein by reference in its entirety.

As used herein, copper number refers to the number of grams of metallic copper (as $Cu_2O$) resulting from the reduction of $CuSO_4$ by 100.00 g of pulp fibers.

Treated Pulp Starting Materials

Starting materials useful for making a treated Kraft pulp can include cellulose and hemicellulose. Examples of starting materials include, for example, wood and recycled paper. The starting materials are initially converted to a pulp. The pulp can be, for example, a chemical wood pulp, such as a Kraft wood pulp or a bleached Kraft wood pulp.

In the wood pulping industry, trees are conventionally classified as either hardwood or softwood. Pulp for use as starting material can be derived from softwood tree species such as, but not limited to: fir (e.g., douglas fir and balsam fir), pine (e.g., eastern white pine and loblolly pine), spruce (e.g., white spruce), larch (e.g., eastern larch), cedar, and hemlock (e.g., eastern and western hemlock). Examples of hardwood species from which pulp can be derived include, but are not limited to: acacia, alder (e.g., red alder and European black alder), aspen (e.g., quaking aspen), beech, birch, oak (e.g., white oak), gum trees (preferably eucalyptus and sweetgum), poplar (preferably balsam poplar, eastern cottonwood, black cottonwood and yellow poplar), gmelina and maple (preferably sugar maple, red maple, silver maple and bigleaf maple).

Wood from softwood or hardwood species generally includes three major components: cellulose, hemicellulose, and lignin. Cellulose makes up about 50% of the woody structure of plants and is an unbranched polymer of D-glucose monomers. Individual cellulose polymer chains associate to form thicker microfibrils which, in turn, associate to form fibrils which are arranged into bundles. The bundles form fibers which are visible as components of the plant cell wall when viewed at high magnification under a light microscope or a scanning electron microscope. Cellulose is highly crystalline as a result of extensive intramolecular and intermolecular hydrogen bonding.

Hemicellulose is a heterogeneous group of low molecular weight carbohydrate polymers such as xylan and mannan that are associated with cellulose in wood. Hemicelluloses are amorphous, branched polymers, in contrast to cellulose which is a linear polymer.

Lignin is a complex aromatic polymer and comprises about 20% to 40% of wood where it occurs as an amorphous polymer.

Kraft Process

In general, a Kraft pulping process involves the chemical digesting of wood chips at elevated temperature and pressure in "white liquor", which is a water solution of sodium sulfide and sodium hydroxide. The white liquor chemically dissolves the lignin that binds the cellulose fibers together. In a batch digester, when cooking is complete, the contents of the digester are transferred to an atmospheric tank usually referred to as a blow tank. The entire contents of the blow tank are sent to pulp washers, where the spent cooking liquor is separated from the pulp. The pulp then proceeds through various stages of washing, and possibly bleaching, after which it is pressed and dried into the finished product.

The Kraft process is designed to recover the cooking chemicals and heat. Spent cooking liquor and the pulp wash water are combined to form a weak black liquor which is concentrated in a multiple-effect evaporator system to about 55% solids. The black liquor is then further concentrated to 65% solids in a direct-contact evaporator, by bringing the liquor into contact with the flue gases from the recovery furnace, or in an indirect-contact concentrator. The strong black liquor is then fired in a recovery furnace. Combustion of the organics dissolved in the black liquor provides heat for generating process steam and for converting sodium sulfate to sodium sulfide. Inorganic chemicals present in the black liquor collect as a molten smelt at the bottom of the furnace. The smelt is dissolved in water to form green liquor, which is transferred to a causticizing tank where quicklime (calcium oxide) is added to convert the solution back to white liquor for return to the digester system. A lime mud precipitates from the causticizing tank, after which it is calcined in a lime kiln to regenerate quicklime.

Referring to FIG. 1, within the pulping process, generally indicated at 126, there are several operations, depicted at 100-116. Loading, or feeding chips, occurs at 100. The wood chips can be presteamed prior to cooking, at 102. Steam at atmospheric pressure preheats the chips and drives off air so that liquor penetration will be enhanced. After the presteaming operation is completed, cooking liquor, referred to as white liquor, containing the pulping chemicals can be added to the chips, at 104. The white liquor and chips are then fed into the digester. In Kraft pulping, the active chemical compounds are NaOH and Na2S. Other chemicals can be added to influence or impart desirable effects on the pulping process.

Impregnation, at 106, is the period during which the chemicals are allowed to impregnate the wood material including low specific gravity wood material. Good liquor penetration helps assure a uniform cooking of the chips. Low specific gravity wood promotes liquid penetration, pulping, and can reduce viscosity.

"Cooking" occurs at 108 and 110. The co-current liquid contact operation at 108 is followed by the counter-current liquid contact operation, at 110. In either operation, the cooking liquor and chips can be brought to temperature.

Digester washing, at 112, is accomplished by introducing wash liquor into the bottom of the digester and having it flow counter-current to the cooked pulp. Cooking for the most part ends when the pulp encounters the cooler wash liquor.

Upon completion of the cook operation, and digester washing, the digester contents are blown, at 112. Digester blowing involves releasing the wood chips and liquor at atmospheric pressure. The release occurs with a sufficient amount of force to cause fiber separation. If desired, the blow tank can be equipped with heat recovery equipment to reduce operating expenses.

At 114, the pulp is sent from the blow tank to external brownstock pulp washers. The separation of black liquor from the pulp occurs at the brownstock washers.

Following the pulping process 126, the brownstock pulp is bleached to reduce its viscosity. The bleaching process does not lead to a substantial reduction of the hemicellulose content of the pulp. Bleaching of chemical pulps involves the removal of lignin with an attendant decrease in the pulp fiber length and viscosity. However, the bleaching process does not cause a substantial reduction to the hemicellulose content of the pulp.

The pulp can then be treated with various chemicals at different stages in the bleach plant. The stages are carried out in vessels or towers of conventional design. The bleaching process is typically a sequence of operations, such as one or more bleaching stages with different bleaching agents (e.g., oxygen, chlorine dioxide, etc.), extraction stages, other treatment stages, and so forth. The bleaching sequence may be identified and/or referred to in terms of the order of the operations performed in the sequence. For example, one representative bleaching sequence is $ODE_pD$. As discussed in greater detail below, such a bleaching sequence includes an oxygen bleaching stage (an "0 stage"), followed by a first chlorine dioxide bleaching stage (a "D stage"), followed by an extraction stage (an "E stage"), and a second D stage. The operations of the representative $ODE_pD$ sequence occurring in the bleaching plant are represented collectively by reference numeral 128 in FIG. 1. Other embodiments of post bleaching the pulp after pulping are described in U.S. Pat. Nos. 6,331,354, and 6,605,350, incorporated herein by reference each in its entirety.

As noted above, the first stage of the representative $ODE_pD$ bleaching sequence 128 is an O stage, at 116. The O stage includes bleaching with oxygen. Oxygen bleaching is the delignification of pulps using oxygen under pressure. The oxygen is considered to be less specific for the removal of lignin than the chlorine compounds. Oxygen bleaching takes place in an oxygen reactor. Suitable oxygen reactors capable of carrying out the method of the present invention are described in U.S. Pat. Nos. 4,295,925; 4,295,926; 4,298,426; and 4,295,927, each of which is incorporated herein by reference in its entirety. The reactor can operate at a high consistency, wherein the consistency of the feedstream to the reactor is greater than 20% or it can operate at medium consistency, where the medium consistency ranges between 8% up to 20%. In some embodiments, if a high consistency oxygen reactor is used, the oxygen pressure can reach the maximum pressure rating for the reactor (e.g., greater than 0 to about 85 psig). In medium consistency reactors, the oxygen can be present in an amount ranging from greater than 0 to about 100 pounds per ton of the pulp (e.g., about 50 to about 80 pounds per ton of pulp). The temperature of the O stage can range from about 100° C. to about 140° C.

D stage, at 118, follows the O stage 116. The D stage includes bleaching the pulp coming from the oxygen reactor with chlorine dioxide. Chlorine dioxide is more selective than oxygen for removing lignin. The amount of chlorine dioxide used in this stage can range from about 20 to about 30 lbs/ton. The temperature of the D stage can range from about 50° C. to about 85° C. In some embodiments, bleaching agents include, but are not limited to, chlorine, chlorine dioxide, sodium hypochlorite, peracids and hydrogen peroxide.

In some embodiments, an $E_p$ or $E_{op}$ stage, at 120, follows the D stage 118. The $E_p$ or $E_{op}$ stage is a hydrogen peroxide reinforced extraction stage where lignin is removed from the pulp using caustic in an amount ranging from about 20 to about 100 lb/ton. The amount of hydrogen peroxide can range from about 20 to about 100 lb/ton. The temperature of the $E_p$ stage can range from about 75° C. to about 95° C. In an $E_{op}$ stage, oxygen is present, whereas oxygen is absent in an $E_p$ stage.

In some embodiments, a second pulp bleaching stage—a $D_{final}$ stage—at 122, follows the $E_p$ or $E_{op}$ stage 120. The amount of chlorine dioxide used in this stage can range from 10 to about 30 lb/ton. The temperature of the $D_{final}$ stage can range from about 60° C. to about 90° C.

In some embodiments, other bleaching sequences, such as DEDED, or DEED (subscripts omitted) can be used. Optionally, after O stage (116), D (118), E (120), D (122) or any bleaching stage, there will be a wash stage before going to the next bleaching stage.

Modified Kraft Process

In the methods of the invention, the bleaching sequence in the Kraft process above can be modified by adding an acid and/or enzyme treatment step, or another viscosity lowering step (infra) between the O and D stages, between the $E_{op}/E_p$ and $D_{final}$ stages, and/or immediately after the $D_{final}$ stage.

The acid can include, for example: hydrochloric, phosphoric, sulfuric, acetic and nitric acids, provided that the pH of the acidified solution can be controlled. In some embodiments, sulfuric acid is selected because it is a strong acid that does not cause a significant corrosion problem when utilized in an industrial scale process. The term "acid" may also refer herein to an acid substitute, which is a compound which forms an acid when dissolved in a solution containing the pulp. Examples of acid substitutes include sulfur dioxide gas, nitrogen dioxide gas, carbon dioxide gas and chlorine gas. Generally, acid can degrade cellulose to control viscosity, which can increase processability using a spinning process. However, acid treatment can also decrease cellulose alpha content or R18, a high value of each of which is a desirable characteristic of dissolving grade pulps. Here, it has been discovered that a small range of acid concentrations can be used to treat pulp to increase R18, and that a milder acid treatment does not significantly decrease pulp viscosity, but can increase both R18 and reactivity. In some embodiments, the acid concentration is 0.05% or more (e.g., 0.1% or more, or 0.3% or more) in water and/or 0.5% or less (e.g., 0.3% or less, or 0.1% or less) in water, with the pulp at a consistency of 5% or more (e.g., 15% or more) in water and/or 30% or less (e.g., 15% or less) in water. For example, the acid concentration is 0.05% to 0.5% by weight in water with pulp at 5% to 30% consistency in water. Without wishing to be bound by theory, it is believed that higher acid concentration at 0.5% or higher will result in lower pulp R18. In some embodiments, treatment temperature can be from 20° C. to 180° C. and treatment time from 15 to 600 minutes. For example, the treatment temperature can be 20° C. or more (e.g., 50° C. or more, 90° C. or more, 120° C. or more) and/or 180° C. or less (e.g., 120° C. or less, 90° C. or less, about 50° C. or less). For example, the treatment time can be 15 minutes or more (e.g., 120 minutes or more, 300 minutes or more, or 480 minutes or more) and/or 600 minutes or less (e.g., 480 minutes or less, 300 minutes or less, or 120 minutes or less).

Where an acid or a combination thereof is utilized to treat the pulp, an amount of acid can be added to the pulp sufficient to adjust the pH of the pulp to a value within the range of from about 0.0 to about 5.0; preferably in the range of from about 0.0 to about 3.0; most preferably in the range of from about 0.5 to about 2.0. The acid treatment will be conducted for a period of from about 2 minutes to about 10 hours at a temperature of from about 20° C. to about 180° C.; preferably from about 50° C. to about 150° C.; most preferably from about 60° C. to about 95° C.

Suitable enzymes include, for example, xylanase, laccase, pectinase, lipase, peroxidase, mannanase, and/or cellulase. The enzyme can be added in an amount of 0.1 to 10 kg/ton of pulp. For example, the enzyme can be added in an amount of 0.1 kg/ton or more (e.g., 2 kg/ton or more, 5 kg/ton or more, or 8 kg/ton or more) of pulp and/or 10 kg/ton or less (e.g., 8 kg/ton or less, 5 kg/ton or less, or 2 kg/ton or less) of pulp. The enzyme can operate at a temperature of from 20° C. to 100° C. For example, the enzyme an operate at a temperature of 20° C. or more (e.g., 40° C. or more, 60° C. or more, or 80° C. or more) and/or 100° C. or less (e.g., 80° C. or less, 60° C. or less, or 40° C. or less). The enzyme can operate at a pH of from about 3 to 12. For example, the enzyme can operate at a pH of 3 or more (e.g., 5 or more, 7 or more, 9 or more, and 11 or more) and/or 12 or less (e.g., 11 or less, 9 or less, 7 or less, or 5 or less). The enzyme can operate for a duration of 5 minutes to 10 hours. For example, the enzyme treatment time can be 5 minutes or more (e.g., 120 minutes or more, 300 minutes or more, or 480 minutes or more) and/or 600 minutes or less (e.g., 480 minutes or less, 300 minutes or less, or 120 minutes or less). The enzyme can be recuperated from process water and can remain active for subsequent rounds of treatment.

To make a Kraft pulp suitable for rayon applications, pulp viscosity can be lowered using a variety of other processes, in addition to acid and/or enzyme treatments described above. For example, pulp viscosity can be lowered by cooking wood chips to low kappa (e.g., from 10 to 20, from 10 to 15, about 10, about 15), delignifying cooked pulp to relatively low viscosity (e.g., kappa from 3 to 10, kappa from 3 to 8, kappa from 3 to 5), and/or bleaching brownstock at an E stage to a final low viscosity. In the Kraft process, caustic is used in these stages and can affect pulp reactivity. It was discovered that high dosage of caustic at different stage can either increase or decrease reactivity and a milder E stage can improve reactivity if the low pulp viscosity can be achieved with other means. An acid stage can lower viscosity, thus providing conditions suitable for a milder E stage; and an acid stage can also change fiber morphology in a different way than caustic treatment, which can result in higher pulp accessibility, reactivity, and/or increased R18 for better steeping and xanthation. In addition, other viscosity lowering stages or their combination can lower pulp viscosity for milder E stage. As an example, a viscosity lowering stage can include oxidation from TEMPO catalyst as described in U.S. Pat. No. 6,379,494, hypochlorite, chlorine oxide at alkaline conditions as described in U.S. Pat. No. 6,471,727, or other oxidants (as described in U.S. Pat. No. 6,331,354), each incorporated herein in its entirety.

In some embodiments, an enzyme treatment stage can occur simultaneously with an acid treatment stage (e.g., at a pH of about 3, about 4, about 5, or about 6). The acid stage with steady pH determines the enzyme stage pH. In some embodiments, the enzyme treatment stage occurs separately from an acid treatment stage. In some embodiments, an enzyme treatment stage can be combined with another viscosity lowering stage, such as an oxidation treatment, cooking wood chip to low kappa, delignifying cooked pulp to relatively low viscosity, and/or bleaching a brownstock at an E stage. In some embodiments, a bleaching sequence can have one or more enzyme treatment stages, one or more acid treatment stages, and/or one or more other viscosity lowering stages.

Treated Pulp Characteristics

As noted above, the invention provides a treated pulp characterized by hemicellulose content (5% or more), an R18 value (88% or more), reactivity (as measured by at least one reactivity value selected from a standard reactivity of 3.5 mL or more, a modified reactivity of 30 mL or more, a filter value $K_r$ of 10,000 or less, a SEM fiber segment count of 11 or less per 100 $\mu m^2$ of a filter when the pulp is subjected to a modified reactivity test), a crystallite cross-section of less than 20.6 $nm^2$, and having less than 8% by weight of cellulose II as determined by x-ray crystallography.

Hemicellulose Content.

Treated pulp of the invention obtained by the modified Kraft process is characterized as having a hemicellulose content of 4% or more (e.g., 7% or more, 9% or more, or 11% or more) and/or 12.5% or less (e.g., 11% or less, 9% or less, or 7% or less) by weight. For example, the treated pulp can have a hemicellulose content of from 4% to 12.5%, from 7% to 12.5%, or from 8% to 12% by weight. Lower hemicellulose pulp (e.g., especially a treated pulp with less low molecular weight hemicellulose) can have less negative impact on steeping, steeping lye recovery, and dope quality. The hemicellulose content (i.e., defined herein as the sum of mannan and xylan content) can be measured using a Weyerhaeuser sugar analysis test, as described in U.S. Pat. No. 7,390,566, incorporated herein by reference in its entirety. The hemicellulose test is based on TAPPI 1249-cm00 with analysis by Dionex ion chromatography. As used herein, the term "% by weight" or "weight percentage", or grammatical equivalents thereof, means weight percentage relative to the dry weight of the treated pulp.

Pentosan Content.

In some embodiments, the treated pulp can have a pentosan content of 4.6% or more (e.g., 5% or more, 6% or more, or 7% or more) and/or 9% or less (e.g., 7% or less, 6% or less, or 5% or less). For example, the treated pulp can have a pentosan content of from 4% to 9%, from 4.6% to 7%, or from 5% to 6.5%. The pentosan content can be measured using Tappi method T223.

Xylan Content.

In some embodiments, the treated pulp can have a xylan content of 4% or more (e.g., 5% or more, 6% or more, or 7% or more) and/or 8% or less (e.g., 7% or less, 6% or less, or 5% or less). For example, the treated pulp can have a xylan content of from 4% to 8%, from 5% to 7%, or from 5.5% to 6.5%.

Mannan Content.

In some embodiments, the treated pulp can have a mannan content of 3% or more (e.g., 4% or more, 5% or more, 6% or more, or 7% or more) and/or 8% or less (7% or less, 6% or less, 5% or less, or 4% or less). For example, the treated pulp can have a mannan content of from 3% to 8%, from 4% to 7%, or from 5% to 6%.

Mannan and xylan content can be obtained when hemicellulose content of the pulp is analyzed. A lower pentosan, lower xylan, and/or lower mannan pulp can have less negative impact on steeping, steeping lye recovery, and dope quality. Steeping lye recovery refers to the recovery of steeping lye in the steeping process. Low molecular weight xylan and mannan in pulp will leach out into the steeping lye and can increase steeping lye viscosity decreasing steeping/filtration rate and blocking filtration membrane systems making it difficult to recover steeping lye (NaOH). Remaining low molecular weight xylan and mannan will go to dope making stage and consume carbon dioxide affecting overall dope quality.

R10 and R18 Values.

In some embodiments, the treated pulp has a R18 value that is 88% or more (e.g., 89% or more, 90% or more, or 91% or more) and/or 92% or less (e.g., 91% or less, 90% or less, or 89% or less). For example, the treated pulp can have a R18 of from 88% to 92%, from 89% to 91%, or from 90% to 90.5%. In some embodiments, the treated pulp has a R10 value that is 86% or more (e.g., 87% or more, or 88% or more) and/or 89% or less (e.g., 88% or less, or 87% or less). In some embodiments, the treated pulp can have a R10 of from 86% to 89%, from 87% to 88.5%, or from 87.5% to 88%. Maintaining relatively high hemicelluloses content and relatively high R18, R10 requires preferential removal of lower molecular weight hemicellulose in pulping and bleaching process. Milder acid treatment, specific enzyme treatment and other optimized extraction can provide the balance. The R10 and R18 values can be measured using Tappi method T235. Higher R18 pulp can enhance rayon yield, and a pulp with higher R10 at a fixed R18 value can increase fiber strength.

Reactivity.

As discussed above, pulp reactivity can be related to the morphological, crystalline and molecular structure of the pulp being tested. Cellulose chains in less accessible regions, such as in crystalline regions of a fiber, have least reactivity. Pulp reactivity can be measured by many methods to reflect different aspects of a pulp. It is believed that "pulp reactivity" depends, to a large extent, on the method of analysis that is used in a given case. (See, e.g., Linda Östberg and Ulf Germgård, "Some aspects on the activation of dissolving pulps and the influence on the reactivity in a following viscose stage," *Cellulose Chem. Technol.*, 47, 3-4, 165-169, 2013, incorporated by reference herein in its entirety.)

The reactivity of a treated pulp can be measured by a variety of methods. In some embodiments, the treated pulp's reactivity can be measured using a standard lab reactivity test, as described in Example 1, infra; a modified reactivity test, as described in Example 2, infra; by obtaining the SEM undissolved fiber segment count (e.g., for latewood) remaining on a filter following the modified reactivity test, as described in Example 3, infra; a filter value test ($K_w$ and $K_r$), as described in Example 4, infra; and $K_w/K_r$ test, as described in U.S. Pat. No. 7,390,566, incorporated by reference herein in its entirety; and/or by measuring the pulp's cellulose crystalline structure measurement, as described in Example 5, infra. It is believed that the reactivity values obtained by the different methods are indicative of different aspects of reactivity, and the results from different reactivity tests are not necessarily duplicative or correlated.

In some embodiments, one or more reactivity testing methods can be used, such as to provide a more thorough assessment of the reactivity of a treated pulp. For example, the treated pulp may have at least one reactivity value selected from a standard reactivity test, a modified reactivity test, a SEM fiber segment count test, a filter value $K_w$ or $K_r$, a gamma number, and a crystallite cross-sectional area.

In some embodiments, the treated pulp can have a standard reactivity value of 3.5 mL or more (e.g., 5 mL or more, 10 mL or more, 30 mL or more, or 50 mL or more) and/or 100 mL or less (e.g., 50 mL or less, 30 mL or less, 10 mL or less, or 5 mL or less). In general, the higher the standard reactivity value, the greater the reactivity. Higher reactivity pulp has less negative impact on dope filtration since higher reactivity pulp can react with carbon disulfide more completely than lower reactivity pulp to form homogenous dope. The resultant dope can pass a filtration stage more easily with less clogging.

In some embodiments, the treated pulp can have a modified reactivity test value ("MRT") of 30 mL or more (e.g., 50 mL or more, 100 mL or more, or 150 mL or more) and/or 190 mL or less (e.g., 150 mL or less, 100 mL or less, or 50 mL or less). In some embodiments, a pulp with modified reactivity test value of 30 mL or more is suitable for blending with dissolving wood pulp for viscose application with improved performance or productivity. A modified reactivity test can reveal the utilities of a pulp when additional carbon disulfide is added to a reaction mixture: a pulp with smaller standard reactivity value can continue to react with carbon disulfide if additional carbon disulfide is added to the pulp reaction mixture, and can demonstrate a more complete reaction during the viscose process, when compared to the same pulp without additional carbon disulfide addition or can demonstrate the same complete reaction during the viscose process, when compared to a pulp with greater standard reactivity value under standard carbon disulfide addition condition. Thus, end users of the treated pulp can adjust processing conditions for a pulp with high MRT, even if the pulp has low standard reactivity value, under conditions where less carbon disulfide is added, by introducing additional carbon disulfide to enhance the reaction between the treated pulp and carbon disulfide to produce a dope with suitable processing properties (e.g., for filtration and spinning).

In some embodiments, the treated pulp can have a SEM fiber segment count for undissolved fibers (e.g., latewood fibers) remaining on a filter following the modified reactivity test of less than 20 fibers segments per 100 $\mu m^2$ of a filter (e.g., less than 11 fiber segments per 100 $\mu m^2$ of a filter, less than 5 fiber segments per 100 $\mu m^2$ of a filter, or less than 3 fiber segments per 100 $\mu m^2$ of a filter). In some embodiments, a sample with poor reactivity can have more than 11 fiber segments per 100 $\mu m^2$ of a filter (e.g., more than 20 fiber segments per 100 $\mu m^2$ of a filter) remaining on the filter. Without wishing to be bound by theory, it is believed that inadequately processed latewood, mostly contributes to poor reactivity.

In some embodiments, filter values $K_r$ and/or $K_w$ (also referred to as the Fraunhofer $K_w$ filter value), where higher $K_r$ indicates a lower reactivity, can be related to filtration resistance and thus related to unreacted fibers, partially reacted fibers, and/or dope viscosity. The treated pulp can have a filter value $K_r$ of 10,000 or less (e.g., 8,000 or less, or 6,000 or less, or 4,000 or less, or 3,000 or less). Without wishing to be bound by theory, it is believed that $K_r$ or $K_w$ value indicates the pulp utilities under a different processing condition (e.g., aged to target viscosity, xanthated with standard chemical addition).

In some embodiments, filter clogging value is used to measure reactivity and a higher clogging value was interpreted as higher reactivity (see, e.g., Verena Gehmayr, Gabriele Schild and Herbert Sixta, "A Precise Study on the Feasibility of Enzyme Treatments of a Kraft Pulp for Viscose Application", *Cellulose* 2011, 18:479-491, incorporated by reference herein in its entirety). Filter clogging value is believed to be related to filtration resistance.

In some embodiments, gamma number can be used to measure reactivity because it reflects the average substitution of cellulose xanthate. Gamma number can be obtained from an experimental procedure for obtaining filter value $K_r$, as described in Example 4, infra. As gamma number is an average, its distribution may be more important for a complete assessment of the xanthate substitution. The treated pulp can have a gamma number of 60% or less, 55% or less, 50% or less, 45% or less, or 40% or less.

In some embodiments, the crystallite size of cellulose in pulp may provide an indication of reactivity (see, e.g., Klaus Fischer, Ingeborg Schmidt, and Steffen Fischer, Reactivity of Dissolving Pulp for Processing Viscose, *Macromolecular Symposium,* 2009, 280, 54-59, incorporated by reference herein in its entirety). A pulp with larger crystallite size can have lower reactivity since cellulose in the larger crystalline region cannot react easily. Measurement of the crystallite size can be done by averaging a portion of a total quantity of the crystallites in a fiber. The treated pulp can have a cellulose crystallite cross-section ("Q") of less than 20.6 $nm^2$ (e.g., less than 19.7 $nm^2$, less than 19.5 $nm^2$, less than 19.3 $nm^2$).

In some embodiments, the treated pulp has less than 8% (e.g., less than 4%, less than 2%, less than 1%, or less than 0.5%) by weight of cellulose II as determined by x-ray crystallography. In some embodiments, the pulp has as little as 0% detectable cellulose II as determined by x-ray crystallography. X-ray crystallography conditions are described, for example, in Example 5, infra. Cellulose II in pulp can be an indication of strong caustic treatment which converts natural cellulose I to a more thermodynamically stable cellulose II structure with accompanying pulp hornification, low pulp accessibility, and low pulp reactivity. Thus, the treated pulp can maintain natural cellulose I concentration and thereby greater reactivity compared to a pulp that has been treated with strong caustic.

Carboxyl Content.

In some embodiments, the pulp further includes a carboxyl content of less than 3.6 meq/100 g pulp (e.g., less than 3 meq/100 g, less than 2 meq/100 g, or less than 1 meq/100 g). The carboxyl content can be measured using Tappi method T237. Lower carboxyl pulp can indicate a low acid hemicellulose group and low pulp oxidation. High carboxyl content can decrease fiber strength.

Viscosity. The treated pulp can have a viscosity measured by one or more of the following methods. The intrinsic viscosity (IV) and degree of polymerization can be measured by ASTM D1795 (DP=190×IV), a capillary viscosity can be measured by Tappi method T230, and a falling ball viscosity can be measured by Tappi method T254. The treated pulp can have a falling ball viscosity of 60 cP or less (e.g., 50 cP or less, 40 cP or less, or 30 cP or less) and/or 20 cP or more (e.g., 30 cP or more, 40 cP or more, or 50 cP or more). The treated pulp can have an intrinsic viscosity of 6 dL/g or less (e.g., 5 dL/g or less, or 4 dL/g or less) and/or 3 dL/g or more (e.g., 4 dL/g or more, or 5 dL/g or more). The treated pulp can have a capillary viscosity of 10 mPa·s or less (e.g., 8 mPa·s or less, 6 mPa·s or less, or 4 mPa·s or less) and/or 4 mPa·s or more (e.g., 6 mPa·s or more, 8 mPa·s or more, or 10 mPa·s or more). A pulp having high viscosity may not age to a desired degree of polymerization within a processing time in a commercial viscose process, especially in a blend with low viscosity dissolving wood pulp. Furthermore, a pulp having a viscosity that is too low can form too many low molecular weight entities during a defined ageing process in a production line, which would negatively impact steeping, dope, and fiber quality.

Degree of Polymerization (DP).

As used herein, the term "degree of polymerization" (DP) refers to the number of D-glucose monomers in a cellulose molecule as measured by ASTM-1795 method. Thus, the term "average degree of polymerization", or "average DP", refers to the average number of D-glucose molecules per cellulose polymer in a population of cellulose polymers. A DP within the foregoing ranges is desirable because, in the range of economically attractive operating conditions, the viscosity of the dope, i.e., the solution of treated pulp from which rayon fibers are produced, is sufficiently low that the dope can be readily aged to a target viscosity, xanthated completely, then extruded through the narrow orifices utilized to form rayon fibers, yet not so low that the steeping process is negatively affected by too many low viscosity molecules and the strength of the resulting rayon fibers is substantially compromised. Preferably the range of DP values of the treated pulp will be unimodal and will have an approximately normal distribution that is centered around the modal DP value (see, e.g., U.S. Pat. No. 6,210,801, incorporated herein by reference in its entirety).

Transition Metal Content.

The treated pulp can have a low transition metal content. Transition metals are undesirable in treated pulp because, for example, they accelerate the degradation of cellulose in the rayon process. Examples of transition metals commonly found in treated pulp derived from trees include iron, copper, nickel and manganese. Preferably, the total transition metal content of the treated pulp is less than about 20 ppm, more preferably less than about 5 ppm. Preferably the iron content of the treated pulp is less than about 4 ppm, more preferably less than about 2 ppm, as measured by acid digestion and analysis by ICP (Tappi method T266), and the copper content of the compositions of the present invention is preferably less than about 1.0 ppm, more preferably less than about 0.5 ppm, as measured by Tappi method T266. In some embodiments, the transition metal includes calcium, and the treated pulp has low calcium content, as determined by TAPPI T266. For example, the calcium content of the treated pulp can be 150 ppm or less (e.g., 100 ppm or less, 60 ppm or less, or 40 ppm or less) and/or 30 ppm or more (e.g., 50 ppm or more, 70 ppm or more, or 100 ppm or more). Low calcium pulp can have less negative impact on spinning (e.g., clogging).

Ash Content.

In some embodiments, the treated pulp has a low ash content, as determined by TAPPI method T211. For example, the ash content of the treated pulp can be 0.15% or less (e.g., 0.12% or less, 0.1% or less, or 0.07% or less or less) and/or 0.02% or more (e.g., 0.04% or more, 0.05% or more, or 0.08% or more). In some embodiments, low ash pulp has less negative impact on spinning stability.

Copper Number.

In some embodiments, the treated pulp has a low copper number, as determined by TAPPI method T430. For example, the copper number of the treated pulp can be 1.6 or less (e.g., 1.2 or less, 1.0 or less, or 0.7 or less) and/or 0.2 or more (e.g., 0.4 or more, 0.5 or more, or 0.8 or more). Low copper number in pulp is related to high rayon brightness.

Silica Content.

In some embodiments, the treated pulp has a low silica content, as determined by an internal Weyerhaeuser silica content test method, as described in Example 6, infra. For example, the silica content of the treated pulp can be 70 ppm or less (e.g., 60 ppm or less, 40 ppm or less, 30 ppm or less, or 20 ppm or less) and/or 20 ppm or more (e.g., 30 ppm or more, 40 ppm or more, or 60 ppm or more). Low silica pulp can have less negative impact on spinning (e.g., clogging).

Brightness.

The treated pulp's brightness can be assessed by Tappi method T525. In general, pulp with high brightness can produce brighter rayon fiber, which is desirable in some applications (e.g., nonwovens). Rayon produced from feedstock that contains the treated pulp can have high brightness due to a low copper number and low carboxyl content in the pulp, and can be more suitable for nonwoven applications (e.g., a spunlaced nonwoven containing the rayon fibers produced from the modified Kraft pulp), even though the treated fiber's strength can be lower than that of dissolving pulp, due to a higher hemicellulose content in the treated fiber (e.g., up to 5%).

Fiber Length.

The fiber length of the treated pulp can be determined on a Fiber Quality Analyzer™ from OPTEST, Hawkesbury, Ontario, according to the manufacturer's standard procedures, and using TAPPI method 271 om-02—Fiber Length of Pulp and Paper by Automated Optical Analyzer. The instrument contains a flow cell that uses hydrodynamic focusing to orient curled fibers. These curled fibers can be precisely measured in the imaging region, enabling a characterization of fibers in mill flows containing contaminants.

Treated Pulp Blends

The treated pulp of the invention can be combined with one or more dissolving pulps as a pulp extender, such that the amount of dissolving pulps can be decreased while still providing a dope that can afford rayon. For example, the treated pulp can be blended with a dissolving pulp having a R18 of greater than 92% to form a blend having a total xylan and mannan content of 6% or more. In some embodiments, the blend includes a surfactant, such as a non-ionic surfactant (e.g., Berol Visco 388, Berol Spin, Berol Fintex, etc., from Akzo Nobel, or similar products). In some embodiments, the blend includes at least about 20% by weight or more (e.g., 25% by weight or more, or 30% by weight or more) of the treated pulp. A blend that has a higher percentage of treated pulp can have a lower amount of dissolving pulps, which can decrease costs of manufacture and maximize use of wood components.

The blend can have a filter value $K_r$ of 15,000 or less (e.g., 10,000 or less, 9000 or less, 8000 or less, 7000 or less, 5000 or less) and/or 3000 or more (e.g., 5000 or more, 7000 or more, 8000 or more, 9000 or more, or 10,000 or more). In some embodiments, the blend has a filter value $K_r$ of between 3000 to 9000.

In some embodiments, the blend has a gamma number of 45.1% or more (e.g., 46% or more, or a gamma number of 47% or more).

The disclosure will be described in greater detail by way of specific examples. The following examples are offered for illustrative purposes, and are not intended to limit the disclosure in any manner. Those of skill in the art will readily recognize a variety of noncritical parameters which can be changed or modified to yield essentially the same results.

EXAMPLES

Example 1: Protocol for Standard Reactivity Test

In this example, a protocol for the standard reactivity test (based on Chinese National Standard Test FZ/T50010.13) is described.

Weigh 7.7 gram of pulp (oven dry basis) and place the pulp in a Teflon bottle (250 mL). Add 180.5 mL 13.7% NaOH to the bottle. Insert stirrer with a fitted cap, stir the pulp slurry for 5 min at 2000 RPM. Cap bottle. Handshake to disperse possible fiber bundles at the bottom of the bottle (turn bottle upside down a few times). Then stir pulp slurry for 2 more min at 2000 RPM.

Remove stirrer with fitted cap, and move bottles to a fumehood. Add 4.0 mL carbon disulfide ($CS_2$) to the bottle. Cap the bottle (start timer: time Zero). Hand-shake.

Clamp the bottle tightly to a Burrell Wrist Action Shaker with 4 clamps (4 sample bottles can be processed at the same time) and shake the bottle with a lever arm setting at 7.5 for 4 hours to dissolve cellulose pulp. After four hours, move the bottles to a hood to ripen the viscose for 24 hours.

At 24 hours time starting from $CS_2$ addition, decant all cellulose solution (dope) from the bottle to a stainless steel cylinder filter device (the device has a 3.2 cm inner cylinder diameter, 25 cm cylinder length, a stainless steel filter with 200×200 mesh and 0.0016 inch wire diameter was fitted between the end cap and a stainless steel O ring to provide an effective filter diameter of 2.8 cm). Time zero when first drop of dope flows through the filter to a collection cylinder and measure the dope volume in one and two minutes. The standard reactivity is defined as the dope volume in mL through the filter during the first one minute.

Example 2: Protocol for Modified Reactivity Test (MRT)

Because treated Kraft pulp is not dissolving pulp, its reactivity is generally low to medium compared with dissolving pulp. To assess its suitability for viscose application, a modified reactivity test is used. The procedure for modified reactivity is the same as the lab reactivity test described in Example 1, except 10 mL of $CS_2$ was added and there is no ripen time after four hours shaking. The modified reactivity is defined as the dope volume in mL flowing through the filter during the first one minute. This volume can range from 0 to about 200 mL.

Example 3: SEM Fiber Segment Test

After conducting the MRT test, the filter was placed in water to diffuse out residual solvent to expose possible undissolved fiber segment before drying the filter in air. Dried filters with fiber segment were observed under SEM (scanning electron microscope) at 100, 500 and 2000 magnification and the area with most fiber segments was observed and the fiber segment (from 100 magnification) was counted to calculate the fiber segment/unit area. A sample with high reactivity can have no residue fibers on the filter. A sample with poor reactivity can have more than 11 or 20 fiber segments on the filters. In all experiment, it was identified that undissolved fiber segments remaining on the filters are latewood. Thus, inadequately processed latewood, mostly contributed to the poor reactivity.

Example 4: Ageing and Filter Value Tests ($K_w$ and $K_r$)

Ageing and filter value tests are described in U.S. Pat. No. 7,390,566, incorporated herein in its entirety. A shredded treated pulp was introduced into a vessel containing 17.9% aqueous sodium hydroxide and 0.2% Berol 388 (based on pulp weight). The pulp was stirred to disintegrate, and steeped for 50 minutes at 23° C. (at room temperature). The resulting slurry was then drained to recover the alkali cellulose (AC) and then pressed (pressure: 40 bar) to obtain the press out factor of 2.5-3.2. The resulting alkali cellulose was shredded by means of a laboratory shredder and the shredded material was aged at 30° C. to reach a target DP (Cuox) in the range of DP (Cuox) 340±15 (or DP-Cuen 580 or SCAN intrinsic viscosity of 250 mL/g).

A dry xanthation of alkali cellulose was carried out in a rotary vacuum evaporator. The alkali cellulose was introduced into a flask and the flask was evacuated. Then carbon disulfide ($CS_2$) at 28% weight related on dry cellulose was added to the alkali cellulose. The xanthation took place at 28° C. for 1.5 hours. The cellulose xanthate was dissolved in dilute aqueous NaOH, to give a solution containing 8.5% cellulose and 6.0% total NaOH. The dissolution continued for 2 hours at 8° C. to produce viscose solution. The ripening of the viscose was carried out at ambient temperature for several hours.

The degree of substitution (DS) was determined from the fresh viscose. Degree of substitution (DS, or gamma number) was determined by iodometric titration after destroying of the by-products with $CO_2$. The gamma number is given in %, with 100% corresponding to a degree of substitution of 1 (see, e.g., Linda Ostberg, Helena Hakansson, and Ulf Germgard, Some Aspects of the Reactivity of Pulp Intended for High Viscosity Viscose. BioResources, 7(1), 743-755, 2012, incorporated by reference herein in its entirety). After several hours ripening time, the filter value and the ball fall viscosity of the unfiltered viscose were determined. The ball fall time was measured for the flow time for a steel ball traveling 20 cm in a 2 cm diameter glass tube at 20° C. Filter value $K_w$ was determined by filtration at constant pressure (2 bars) and constant temperature (20° C.). The quantity of filtered viscose for 0-20 minutes and 20-60 minutes was collected and based on the quantities the filter value $K_w$ is calculated. $K_r$ is calculated based on $K_w$.

Example 5: Cellulose Crystalline Structure Measurement

X-ray diffraction of the cellulose pulp was conducted to detect the crystalline structure (cellulose I or cellulose II) and the crystallite size, as described, for example in Klaus Fischer, Ingeborg Schmidt, and Steffen Fischer, Reactivity of Dissolving Pulp for Processing Viscose, *Macromolecular Symposium,* 2009, 280, 54-59, incorporated by reference herein in its entirety.

Example 6: Protocol for Assessing Silica Content in Pulp

Weigh a representative aliquot of sample (5 gram oven dried pulp) into a platinum crucible and record the mass to the nearest 0.001 gram. Use a squirt bottle to add sufficient methanol to wet the entire sample. Ignite the samples in a fumehood and allow them to burn out. Transfer the samples to a muffle oven and ash at 575° C. for 1 hour, or until the samples look completely ashed. Remove samples from the muffle oven and allow them to cool.

Label 10-mL test tubes with the sample I.D. and "HF" using a marker. Add 5 mL of 20% HF and swirl to mix. If there is a substantial amount of undissolved ash (greater than 0.5 mL) present after the initial 5 mL of 20% HF, continue adding 20% HF in 5-mL aliquots until a 1:10 ratio of ash to final volume is obtained.

Transfer the samples into the appropriate labeled test tubes. Note that there will be less volume in the test tube since the entire sample will not transfer. If more than 10 mL of 20% HF was required, transfer to a labeled 50-mL plastic tube. The samples need to sit overnight before analysis to ensure complete dissolution of the silicon and to allow the particles to settle. The final matrix is 20% HF. The sample is now ready for analysis.

The samples are analyzed for silicon by flame atomic absorption spectroscopy (FAAS) and silica in pulp is converted from silicon data using molecular formula ($SiO_2$).

Example 7: Enzyme Treatment after $D_{final}$ Stage

Never dried Kraft pulp from bleaching sequence of $ODE_{op}D$ with falling ball viscosity of 31 cP was treated with 1.5 kg/ton (based on pulp weight) of xylanase from logen (Biobrite UHB) at 72° C. for 5 hours at pH of 7. The treated pulp (C35) has a falling ball viscosity of 31, R18 of 90.2%, xylan content of 5.7%, mannan content of 5.3% or hemicellulose (defined as the sum of xylan and mannan) at 11%, pentosan content of 5.7%, reactivity of 3.7 mL. Sample C35 was repeated except that 2 kg/ton xylanase and 1 kg/ton mannanase from AB enzyme were used at 70° C. for 2.5 hours (sample C43). The treated pulp (sample C43) has a falling ball viscosity of 30.3, R18 of 89.8%, xylan content of 5.5%, mannan content of 5.0% or hemicellulose (defined as the sum of xylan and mannan) at 10.5%, pentosan content of 5.5%, standard reactivity of 4.8 mL. The pulp before treatment (control) has a R18 of 90.1%, xylan content of 6.6%, mannan content of 5.5%, pentosan content of 6.7%, standard reactivity of 3 mL. Enzyme treated pulp had lower xylan content, lower pentosan, and higher reactivity. Results are summarized in Tables 1A, 1B, and Table 2.

Example 8: Acid Treatment Between $E_{op}$ and $D_{final}$ Stages

Never-dried Kraft pulp from bleaching sequence of $ODE_{op}$ was bleached with 0.25% chlorine dioxide (based on pulp) at 70° C. for 210 minutes (control) in a $D_{final}$ step. The bleached (C36) pulp has a falling ball viscosity of 32 cP, ASTM DP of 836 (or IV of 4.4 dL/g), capillary 6.5 mPa·s, R10 of 88.1%, R18 of 89.4%, pentosan content of 6.4%, xylan content of 6.6%, arabinan of 0.4%, mannan content of 5.5%, copper number of 0.4, and standard reactivity of 2.4 mL. The same $ODE_{op}$ pulp was treated with sulfuric acid (0.3% solution) at 85° C. for 1 hour and then bleached with chlorine dioxide with the same condition as control above. The acid treated and bleached pulp (C37) has a falling ball viscosity of 26, ASTM DP of 732 (or IV of 3.95 dL/g), capillary viscosity of 5.41 mPa·s, R10 of 88.3%, R18 of 90.4%, copper number of 0.8, pentosan content of 6.4%, xylan content of 6.6%, mannan content of 5.5%, arabinan of 0.2%, standard reactivity of 68 mL. Acid treated pulp had lower arabinan, higher R18, and higher reactivity. Acid treatment can lead to lower pulp quality (low alpha or R18) if acid concentration, or temperature or pressure or their combinations are too high (see U.S. Pat. No. 6,210,801, incorporated herein by reference in its entirety).

Results are summarized in Tables 1A, 1B, and 2. Table 1A. Characteristics of treated pulp samples and control samples.

Abbreviations for Tables 1A, 1B and 2: A=acid ($H_2SO_4$); C=cellulase; M=mannanase; X=xylanase; PHK=prehydrolyzed pulp; SW=softwood; HW=hardwood; Q=cellulose crystallite cross section.

TABLE 1A

Characteristics of treated pulp samples and control samples

| Sample | Treatment sequence | | | | | | | Gamma number (%) | Filter value ($K_r$) | MRT (mL) | Standard reactivity (mL) | R18 (%) | Q ($nm^2$) |
|---|---|---|---|---|---|---|---|---|---|---|---|---|---|
| Control | O | | D | $E_{op}$ | | $D_{final}$ | | 51.6 | 10182 | 13 | 2.4 | 89.4 | 20.6-21.0 |
| C35 | O | | D | $E_{op}$ | | $D_{final}$ | X | | 7960 | 100 | 3.7 | 90.2 | 17.8 |
| C43 | O | | D | $E_{op}$ | | $D_{final}$ | X and M | 53.4 | 4359 | 136 | 4.8 | 89.8 | 19.4 |
| C37 | O | | D | $E_{op}$ | A | $D_{final}$ | | 50.7 | 3189 | 166 | 68 | 90.4 | 18.4 |
| C38 | O | | D | $E_{op}$ | X and M | $D_{final}$ | | 50.8 | 4700 | 150 | 4 | 89.4 | 17.5 |
| C39 | O | | D | $E_{op}$ | X and C | $D_{final}$ | | 51.3 | 4017 | 122 | 11.7 | 89.3 | 19.0 |
| A | O | A | D | $E_p$ | | $D_{final}$ | | 50.9 | 3830 | 72 to126 | 37 | 90.0 | 19.3 |
| B | O | | D | $E_p$ | | $D_{final}$ | | 52.9 | 3666 | 3 to 4 | 3 | 88.6 | 19.7 |
| Competitive Kraft (SW) | | | | | | | | | | 3 to6 | 1.8 | 88.0 | |
| PHK (HW) | | | | | | | | 47.3 | 4000 | 158 | 65 | 97.1 | 20.0 |
| PHK (SW) | | | | | | | | | | 152 | 47 | 95.4 | 22.8 |

TABLE 1B

Characteristics of treated pulp samples and control samples

| Sample | IV (dL/g) | Falling Ball Viscosity (cP) | ASTM DP | Capillary Viscosity (mPa · s) | Copper Number | R10 wt % | R18 wt % | Xylan wt % | Mannan wt % | Total Xylan & Mannan wt % | Pentosan wt % | SEM Fiber Count (avg)/ 100 $\mu m^2$ |
|---|---|---|---|---|---|---|---|---|---|---|---|---|
| Control | 4.4 | 32 | 836 | 6.5 | 0.4 | 88.1 | 89.4 | 6.6 | 5.5 | 12.1 | 6.4 | 11.3 |
| C35 | | 31 | | | | | 90.2 | 5.7 | 5.3 | 11.0 | 5.7 | 3.4 |
| C43 | | 30.3 | | | | | 89.8 | 5.5 | 5.0 | 10.5 | 5.5 | 2.3 |
| C37 | 3.95 | 26 | 732 | 5.4 | 0.8 | 88.3 | 90.4 | 6.6 | 5.5 | 12.1 | 6.4 | 1.1 |
| C38 | 4.4 | 32 | 836 | 6.4 | 0.6 | 88.2 | 89.4 | 6.0 | 5.0 | 11.0 | 6.2 | 2.3 |
| C39 | 4.2 | 29 | 798 | 6.0 | 0.7 | 87.8 | 89.3 | 6.2 | 5.5 | 11.7 | 6.4 | 4.5 |
| A | | 23 | | 5.33 | 1.1 | 87.4 | 90.0 | 6.31 | 5.44 | 11.74 | 6.6 | 4.5 |
| B | | 31 | | 6.68 | 0.5 | 87.3 | 88.6 | 6.46 | 5.46 | 11.92 | 6.8 | >20* |
| Competition | 5.2 | 36 | 988 | | 0.6 | 86.6 | 88.0 | 7.5 | 5.62 | 13.12 | 7.9 | >30* |
| PHK-HW | 4.8 | 34 | 912 | | 0.4 | 95 | 97.1 | 2.8 | <0.45 | <3.25 | 2.9 | 1.1 |

*difficult to count accurately due to many overlapping fibers

TABLE 2

Characteristics of blends including treated pulps

| Blend sample | Treatment sequence (for treated pulp) | | | | | | | | % in PHK blend | Gamma number (%) | Filter value | Berol 0.2% |
|---|---|---|---|---|---|---|---|---|---|---|---|---|
| 5A | O | | D | $E_{op}$ | | $D_{final}$ | | | 30 | 45.1 | 15000 | Yes |
| 5B | O | | D | $E_{op}$ | | $D_{final}$ | X | | 20 | 46.8 | 5802 | Yes |
| 5C | O | | D | $E_{op}$ | | $D_{final}$ | X | | 30 | 46.1 | 8371 | Yes |
| 6A | O | X | D | $E_p$ | A | $D_{final}$ | | | 30 | 47.7 | 3264 | Yes |
| 6C | O | | D | $E_{op}$ | | $D_{final}$ | | | 20 | 44.3 | 38423 | No |

Example 9: Enzyme Treatment Between $E_{op}$ and $D_{final}$ Stages

Never dried Kraft pulp from bleaching sequence of $ODE_{op}$ was treated with a mixture of xylanase (1 kg/ton based on pulp) and cellulase (1 kg/ton based on pulp) from AB enzyme and then bleached ($D_{final}$) with 0.25% chlorine dioxide (based on pulp) at 70° C. for 210 minutes. The bleached pulp (C39) has a falling ball viscosity of 29 cP, ASTM DP of 798 (or IV of 4.2 dL/g), capillary 6.02 mPa·s, R10 of 87.8%, R18 of 89.3%, pentosan content of 6.4%, xylan content of 6.2%, mannan content of 5.5%, arabinan of 0.35%, copper number of 0.7, standard reactivity of 11.7 mL. This starting pulp was also treated a mixture of xylanase (1 kg/ton based on pulp) and mannanase (1 kg/ton based on pulp) from AB enzyme and then bleached ($D_{final}$) with 0.25% chlorine dioxide (based on pulp) at 70° C. for 210 minutes. The bleached pulp (C38) has a falling ball viscosity of 32 cP, ASTM DP of 836 (or IV of 4.4 dL/g), capillary 6.4 mPa·s, R10 of 88.2%, R18 of 89.4%, pentosan content of 6.2%, xylan content of 6.0%, mannan content of 5.0%, arabinan of 0.39%, copper number of 0.6, standard reactivity of 4 mL. Results are summarized in Tables 1A, 1B, and 2.

Example 10: Acid Treatment Prior to Bleaching Sequence

Never dried Kraft pulp from post oxygen washer with a capillary viscosity of 8.8 mPa·s was bleached as described, for example, in U.S. Pat. Nos. 7,390,566; 6,686,039; and 6,491,788, each of which is incorporated by reference herein in its entirety, using $DE_pD_{final}$ stage as described in these applications with minor change as shown below.

D Stage.

The D stage treated the pulp processed in the O stage by washing it three times with distilled water, pin fluffing the pulp, and then transferring the pulp to a polypropylene bag. The consistency of the pulp in the polypropylene bag was adjusted to 10% with the addition of water. Chlorine dioxide corresponding to an amount equivalent to 0.5% per ton of pulp was introduced to the diluted pulp by dissolving the chlorine dioxide in the water used to adjust the consistency of the pulp in the bag. The bag was sealed and mixed and then held at 70° C. for 45 minutes in a water bath. The pulp was removed and washed with deionized water.

$E_p$ Stage.

The washed pulp from the D stage was then placed in a fresh polypropylene bag and caustic having the same charge as hydrogen peroxide or a pH>11 was introduced with one-half of the amount of water necessary to provide a consistency of 10%. Hydrogen peroxide was mixed with the other one-half of the dilution water and added to the bag. The hydrogen peroxide charge was equivalent to 4% of pulp weight. The bag was sealed and mixed and held for 90 minutes at 70° C. in a water bath. After removing the pulp from the bag and washing it with water, the mat was filtered and then placed back into the polypropylene bag and broken up by hand.

$D_{final}$ Stage. Chlorine dioxide was introduced a second time to the pulp from $E_p$ stage in an amount equivalent to 0.25% of pulp weight with the dilution water necessary to provide a consistency of 10%. The bag was sealed and mixed, and then held for 210 minutes at 70° C. in a water bath to obtain Sample B.

The bleached pulp Sample B has an ISO brightness of 87.8, a capillary viscosity of 5.9 mPa·s from on-site lab testing, and a standard reactivity of 3 mL. The same never dried Kraft pulp from post oxygen washer was first treated with sulfuric acid (0.3% solution) at 90° C. for 5 hour to a capillary viscosity of 7.1 mPa·s and then bleached with the same bleached sequence as Sample B except half amount of caustic and $H_2O_2$ were used. The acid treated and bleached pulp has an ISO brightness of 89.0, a capillary viscosity of 5.6 mPa·s from on-site lab testing. This sample (Sample A) has a standard reactivity of 37 mL. The tests were repeated to make more Samples A and B. These samples were analyzed and results are summarized in Tables 1A, 1B and 2. Acid treated pulp had lower ash, lower metals (Ca, Fe etc.), lower silica, lower carboxyl group, lower arabinan content, higher brightness, higher R18, and higher reactivity than control. Acid treatment can lead to lower pulp quality if acid concentration, or temperature or pressure or their combinations are too high. Their fiber properties such as fiber length and coarseness are similar (Table 3). Other properties of Samples A and B are summarized in Table 3.

TABLE 3

Pulp and fiber properties of a mill sample (control), Samples A and B

| | | A Lab | B Lab | Control Mill |
|---|---|---|---|---|
| Population (fiber/gram) | $\times 10^6$ | 3.6 | 3.6 | 4.6 |
| Coarseness | mg/100 m | 24.6 | 25.0 | 20.2 |
| Kink | 1/mm | 1.1 | 1.0 | 1.8 |
| Curl | deg/mm | 100 | 92 | 72 |
| Length Weighted Fines | % | 3.3 | 3.5 | 3.8 |
| Weight Weighted Fiber Length | mm | 3.21 | 3.21 | 3.25 |
| Length Weighted Fiber Length | mm | 2.47 | 2.46 | 2.51 |
| Arithmetic Fiber Length | mm | 1.13 | 1.12 | 1.09 |
| Ash | % | 0.10 | 0.16 | 0.05 |
| Ca | ppm | 10 | 140 | 38 |
| Co | ppm | <0.1 | <0.1 | |
| Cr | ppm | <0.1 | <0.1 | |
| Cu | ppm | 0.2 | 0.2 | 0.12 |
| Fe | ppm | 2 | 5 | 1 |
| Mg | ppm | <10 | 40 | 3.3 |
| Mn | ppm | <0.1 | 2.6 | 0.3 |
| Na | ppm | 380 | 440 | |
| Ni | ppm | <0.1 | <0.1 | |
| Si | ppm | 22 | 36 | 12 |
| $SiO_2$ | ppm | 47 | 77 | 26 |
| Carboxyl group | meq/100 g | 2.6 | 3.2 | 3.6 |

TABLE 4

Results (Kraft pulp, alkaline cellulose (AC) and viscose dope properties (DP), MRT, Gamma number and filter value, $K_r$)

| | | DP of pulp | | DP of AC | Time for | Gamma | Filter | MRT |
|---|---|---|---|---|---|---|---|---|
| | X + M (%) | Cuox | Cuen | Cuox | AC (hours) | number (%) | value $K_r$ | (mL) |
| C37 | 12.1 | 500 | 865 | 339 | 38 | 50.7 | 3189 | 166 |
| C38 | 11.0 | 573 | 996 | 351 | 41 | 50.8 | 4700 | 150 |

TABLE 4-continued

Results (Kraft pulp, alkaline cellulose (AC) and viscose dope properties (DP), MRT, Gamma number and filter value, $K_r$)

| | X + M (%) | DP of pulp Cuox | DP of pulp Cuen | DP of AC Cuox | Time for AC (hours) | Gamma number (%) | Filter value $K_r$ | MRT (mL) |
|---|---|---|---|---|---|---|---|---|
| C39 | 11.7 | 534 | 926 | 357 | 30 | 51.3 | 4017 | 122 |
| C43 | 10.5 | 571 | 993 | 345 | 32 | 53.4 | 4359 | 136 |
| A | 11.8 | 531 | 921 | 328 | 36 | 50.9 | 3830 | 72, 126 |
| B | 11.9 | 600 | 1045 | 425/333 | 34/52 | 52.9 | 3666 | 3, 4 |
| Control | 11.9 | 585 | 1018 | 339 | 38 | 51.6 | 10182 | 11, 15 |
| Blend | | | | | | | | |
| 5A | 6.7 | 545 | 946 | 342 | 41 | 45.1 | 15000 | Berol |
| 5B | 4.8 | 588 | 1023 | 320 | 44 | 46.8 | 5802 | Berol |
| 5C | 6.7 | 585 | 1018 | 334 | 44 | 46.1 | 8371 | Berol |
| 6A | 6.7 | 602 | 1048 | 314 | 44 | 47.7 | 3264 | Berol |
| 6C | 4.8 | 748 | 1311 | 357 | 48 | 44.3 | 38423 | No Berol |
| PHK | 3.0 | 560 | 973 | 342 | 43 | 47.3 | 4000 | Berol |

Abbreviations for Table 4: X=xylan; M=mannan; DP (Cuox)=18+0.557×DP (Cuen); DP (Cuen) is DP of cellulose from cupriethylenediamine solution (refer SCAN-CM 15:88 intrinsic viscosity procedure). Aging temperature at 30° C. for all samples. Berol=0.2% Berol Visco 388 from Akzo Nobel.

It was also realized that Sample B without acid and enzyme treatment can have high filter value $K_r$ and gamma number although it aged much slower in the viscose process (FIG. 4) and its reactivity is low. The low reactivity was due to bleaching conditions.

Other viscosity reducing methods are tried to lower viscosity of pulp. If hypochlorite is used, chemical dosage or pH adjustment can be used for viscosity control of the same $E_O$ pulp used in the Example 8. Table 5 shows the results of hypochlorite treatment of such a pulp with starting falling ball viscosity of 29 cP.

TABLE 5

Results of hypochorite treatment

| Hypochlorite addition (wt % based on pulp) | Starting pH | Pulp falling ball viscosity (cP) |
|---|---|---|
| 0 | 12.8 | 29 |
| 0.16 | 12.8 | 28 |
| 0.32 | 12.8 | 27 |
| 0.64 | 12.8 | 26 |
| 0.96 | 12.8 | 24 |

Chlorine dioxide was also used to control viscosity of a pulp after first D stage in Example 10. At first, a control pulp was made by bleaching D pulp through normal $E_p$ and $D_{final}$ stage to have intrinsic viscosity 4.6 dL/& Secondly, D pulp was mixed with 0.2% chlorine dioxide (on pulp) and 2% NaOH (on pulp) for 10 minutes at 88° C. (10% pulp consistency in water). This treated pulp will go through normal $E_p$ and $D_{final}$ stage to have intrinsic viscosity of 4.5 dL/g. If the chlorine dioxide dosage was 0.4 or 0.6% respectively, the final pulp viscosity is 4.2 or 4.0 dL/g respectively.

Example 11: Comparative Treated Pulp Data

R18 value, xylan amount, mannan amount, pentosan amount, reactivity, falling ball (FB) viscosity, ASTM DP, and copper number were obtained for two control samples and two commercial pulp samples. The results are summarized in Table 6, below.

TABLE 6

Comparative data

| | Control 1 | Control 2 | PHK (HW-1) | PHK (HW-2) |
|---|---|---|---|---|
| R18 (%) | 90.1 | 89.5 | 96.6 | 97.1 |
| Xylan (%) | 6.6 | 6.5 | 2.8 | 2.8 |
| Mannan (%) | 5.5 | 5.4 | <0.5 | <0.5 |
| Pentosan (%) | 6.7 | 6.8 | 2.8 | 2.9 |
| Standard reactivity (mL) | 2.4-3 | 3 | 3.2 to 37 (not uniform) | 65 |
| FB viscosity (cP) | 31 | 35 | 35 | 29 |
| ASTM DP | 840 | 925 | 925 | 797 |
| Copper number | 0.4 | 0.4 | 0.4 | 0.4 |
| MRT (mL) | 16 | 15 | 133 | 158 |

Example 12: Blends with Prehydrolyzed Kraft Hardwood Dissolving Pulp

Control from Example 1 was dispersed in water with a prehydrolyzed Kraft (Bahia PHK, tables, 2, 4 and 5) hardwood dissolving pulp at a 30/70 ratio (weight) (30% ratio). The pulp slurry was centrifuged to obtain wet pulp with 36% solid. The wet pulp was pin mill fluffed and then dried on a surface at room temperature. The wet, fluffed pulp was sprayed with 0.2% (wt on pulp) Berol Visco 388. After drying, the pulp (5A) was tested for filterability (expressed as $K_r$ value) at Fraunhofer Institute of Applied Polymer Research, Germany. The $K_w$ and $K_r$ for the pulp blend are 18490 and 15000 respectively and the gamma number for the pulp blend is 45.1. Data are summarized in Tables 2 and 4.

Xylanase (Ecopulp TX-800A from AB enzyme) treated control 1 with xylan of 5.2%, mannan of 5.6%, pentosan 5.4% and R18 90.3% was blended with the same PHK pulp as above at 20% and 30% ratio (wt) (5B) at 20% blend and 5° C. at 30% blend). After the same treatment, the $K_r$ values for the pulp blends are 5802 and 8371 for 20 and 30% blend respectively. The gamma numbers for the blends are 46.8 and 46.1 respectively.

Enzyme treated pulp itself may have relatively low reactivity, but can be blended with standard PHK dissolving wood pulp with much higher filterability and high dope quality for viscose production than expected.

Example 13: Pulp Blends with Prehydrolyzed Kraft Hardwood Dissolving Pulp

Never dried Kraft pulp from post oxygen washer was treated with 1.5 kg/ton (based on pulp weight) xylanase from AB enzyme (Ecopulp TX-800A) at 72° C. for 5 hour at a pH of 6.6. The enzyme treated pulp then had standard $DE_p$ bleaching as shown in example 10 except that half caustic and $H_2O_2$ was used at $E_p$ stage. Then the pulp was treated with sulfuric acid at 90° C. for 60 minute (0.25% acid in water). The acid treated pulp had the same final D stage as shown in Example 9. This pulp had 5.2% pentosan, 5.5% xylan, 5.4% manna, 90% R18. The pulp (6A) was blended with the same PHK dissolving pulp at 30/70 ratio (weight) with the same procedure as Example 12. The $K_r$ value for the pulp blend was 3264 and the gamma number for the pulp blend was 47.7. Sample 6C was made in the same fashion as 5A except the blend ratio was 20/80 (Kraft pulp/PH K) and there was no Berol addition.

Example 14: X-Ray Diffraction

Figure 2:
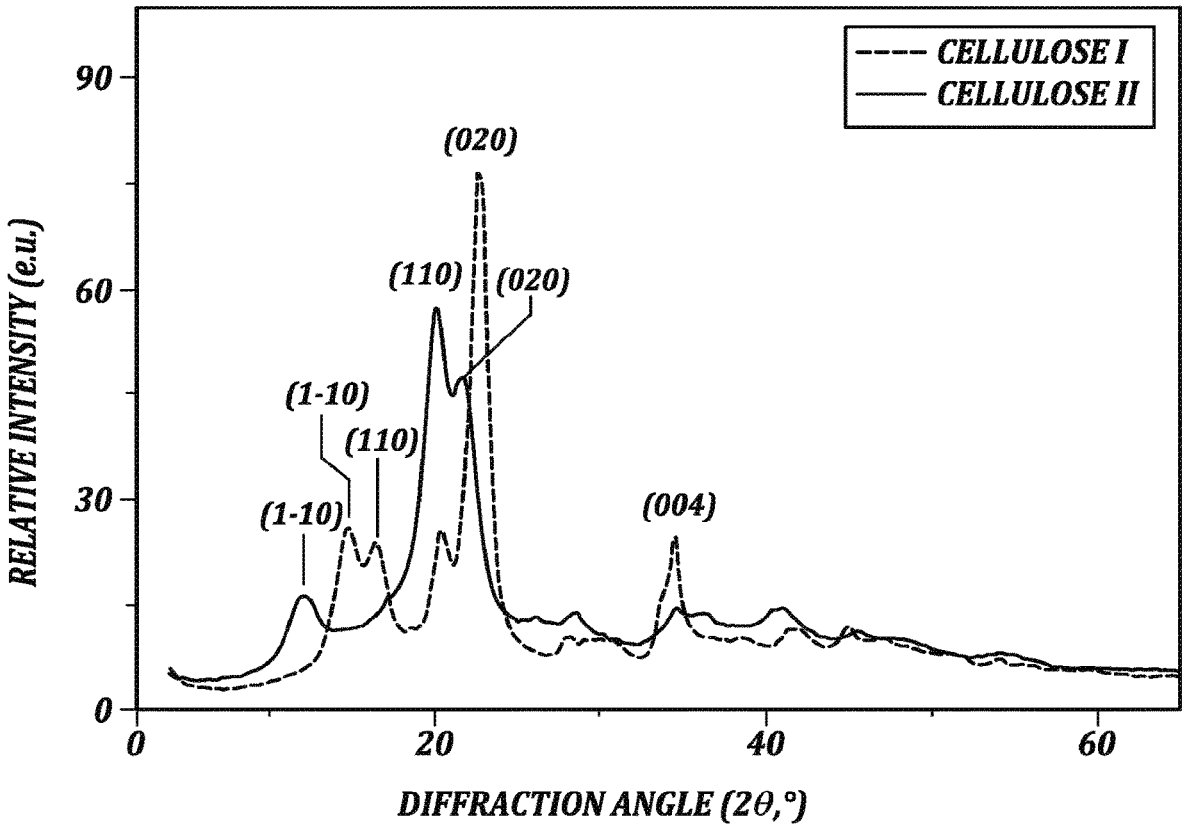
FIG. 2 compares x-ray diffractograms of cellulose I and cellulose II in representative treated pulps of the invention.

X-ray diffraction was done to detect the crystalline structure and crystallite size. The following references were used for cellulose structure identification: Cellulose I (monoclinic, space group P21): a=0.817 nm, b=0.786 nm, c=1.038 nm, gamma=97.0° (K. H. Gardner, J. Blackwell, *Biopolymers* 13, 1975 (1974)) and Cellulose II (monoclinic, space group P21): a=0.801 nm, b=0.904 nm, c=1.036 nm, gamma=117.1 (F. J. Kolpak, J. Blackwell, *Macromolecules* 9, 273 (1976), incorporated by reference herein in its entirety). The Miller indices (hkl) depend on the selected unit cell parameters. The first four cellulose I peaks would be indexed as (1-10), (110), (012) and (020) using the Blackwell unit cell. FIG. 2 showed the standard x-ray diffraction patterns of cellulose I and cellulose II structure.

Figure 3:
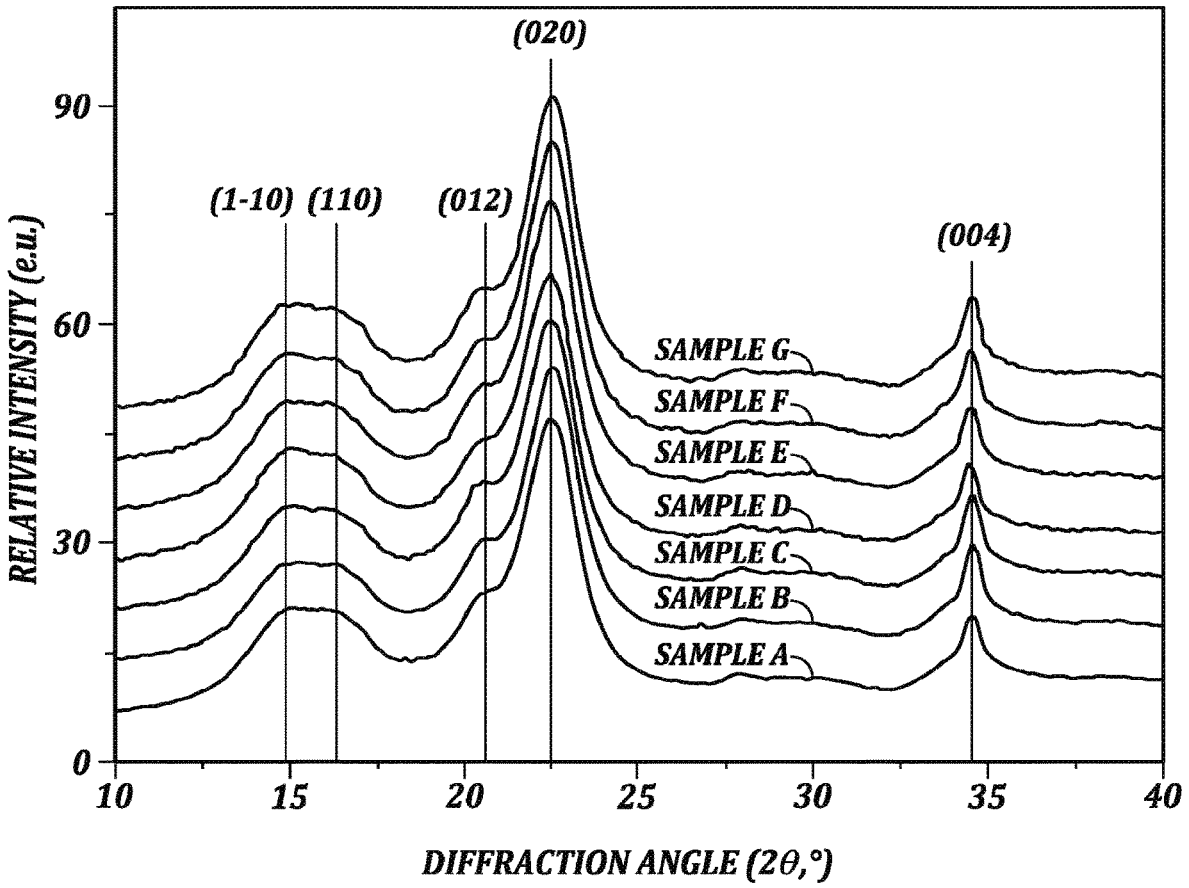
FIG. 3 compares x-ray diffractograms of representative treated pulps of the invention.

Referring to FIG. 3, samples A, B, C, D (C39), E (C43), F (control), G (control) and J (a PHK dissolved grade pulp from softwood, pine) were tested for lattice structure and crystallinity size (D spacing and crystallite cross section Q).

Cellulose I structure was detected from all the Kraft pulp samples (FIG. 3). Normally, cold caustic extracted pulp also had cellulose II structure (Verena Gehmayr etc., "A Precise Study on the Feasibility of Enzyme Treatments of a Kraft Pulp for Viscose Application," Cellulose (2011), 18:479-491. Cellulose II crystallinity was tested using the method described in Thomas Roder et al., CRYSTALLINITY DETERMINATION OF NATIVE CELLULOSE—COMPARISON OF ANALYTICAL METHODS, Lenzinger Berichte, 86 (2006) 85-89.). Treated pulp in this invention did not use strong alkaline treatment and cellulose I structure was preserved. Crystallite size of different samples are summarized in Table 7.

TABLE 7

Crystallite size (D spacing and cross section area) as an indicator of the reactivity

| X-ray graph | Pulp | D1-10 | D110 | D012 | D020 | D004 | Q ($nm^2$) | Kraft pulp treated |
|---|---|---|---|---|---|---|---|---|
| A | A | 4.0 | 4.2 | 6.4 | 4.7 | 13.9 | 19.3 | A |
| B | B | 3.8 | 4.4 | 6.4 | 4.8 | 15.7 | 19.7 | $DE_pD$ |
| D | C39 | 3.8 | 4.3 | 6.3 | 4.7 | 14.0 | 19.0 | DfX |
| E | C43 | 4.1 | 4 | 6.5 | 4.8 | 14.3 | 19.4 | DfX/M |
| F | Kraft | 3.8 | 4.6 | 6.4 | 4.9 | 13.7 | 20.6 | Control |
| G | Kraft | 3.9 | 4.5 | 6.8 | 5.0 | 14.5 | 21.0 | Control |
| J | PHK-SW | 4.1 | 4.5 | 7.1 | 5.3 | 14.3 | 22.8 | commercial |

Sample J is a PHK dissolving pulp from softwood pine.

Example 15: Treated Pulp Ageing

Figure 4:
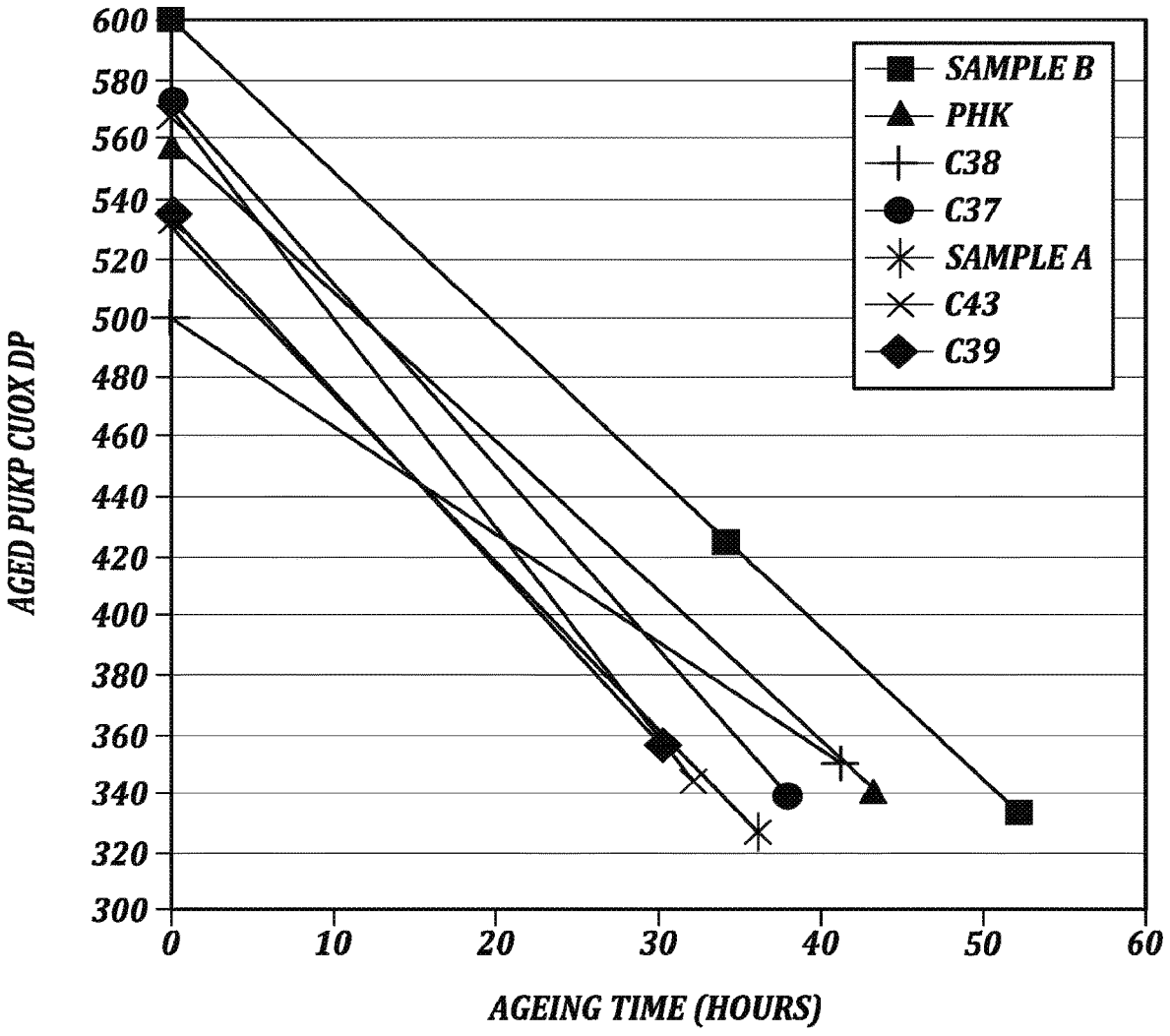
FIG. 4 compares ageing rates for representative treated pulps of the invention.

Referring to FIG. 4, a treated pulp C39, C43, Sample A had reached to target DP (target DP (Cuox) in the range of DP (Cuox) 340±15) in about 30, 32 and 36 hours respectively showing a matched, ageing behavior as the dissolving pulp, which reached target DP in 43 hours. Sample B, on the other hand, needed 53 hours to reach target DP (following relationship: Aged pulp DP (Cuox)=−5.1362×T ageing time+599.91) or 50.6 hour will be needed to reach a Cuox DP of 340. Cuox or Cuoxam DP was measured by Fraunhofer Institute for Applied Polymer Research, as described, for example, in U.S. Pat. No. 8,454,884, incorporated herein in its entirety). In a pulp blend comprising Kraft pulp and dissolving pulp (wood pulp, cotton linter pulp or bamboo pulp), it is necessary that each pulp component can age to reach target DP at similar process times. A pulp component with too early or too late ageing behavior compared with the majority pulp in the blend will affect the whole process or dope quality.

Example 16: SEM Fiber Segment Count

Figure 5A:
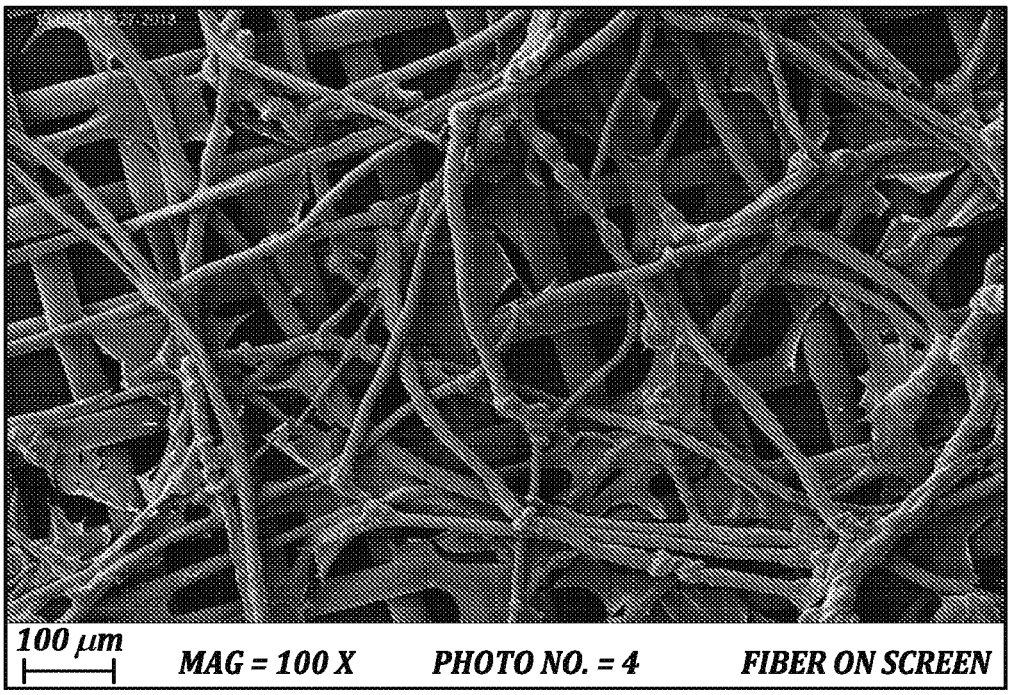
FIGS. 5A and 5B are scanning electron micrographs of undissolved fibers on a filter.
Figure 5B:
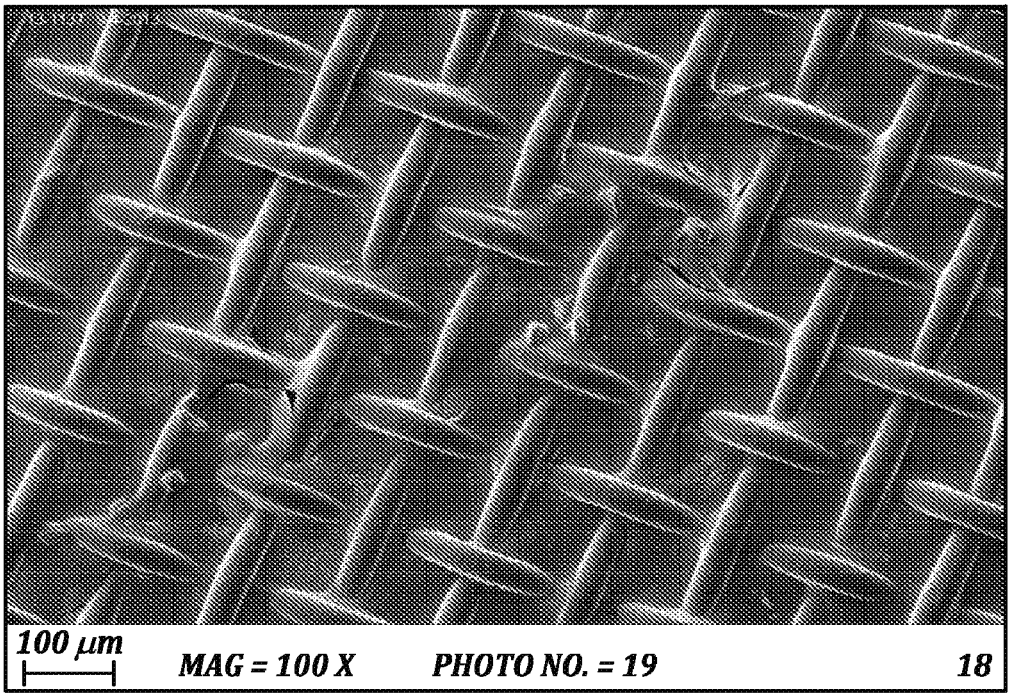
Figure 5C:
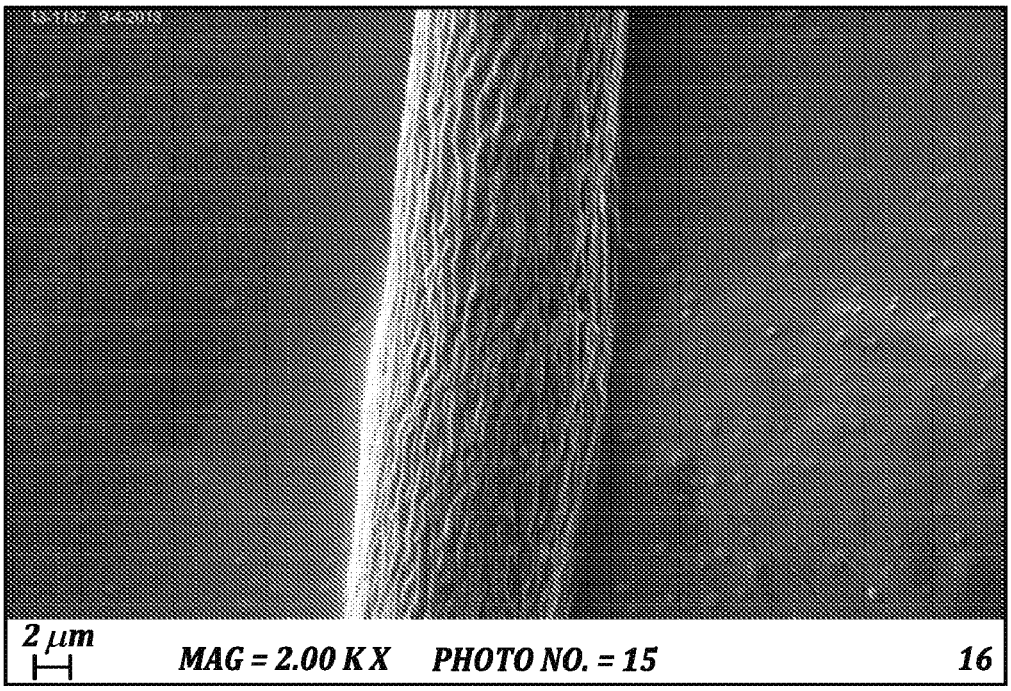
FIG. 5C is a scanning electron micrograph of undissolved latewood on a filter.
Figure 5D:
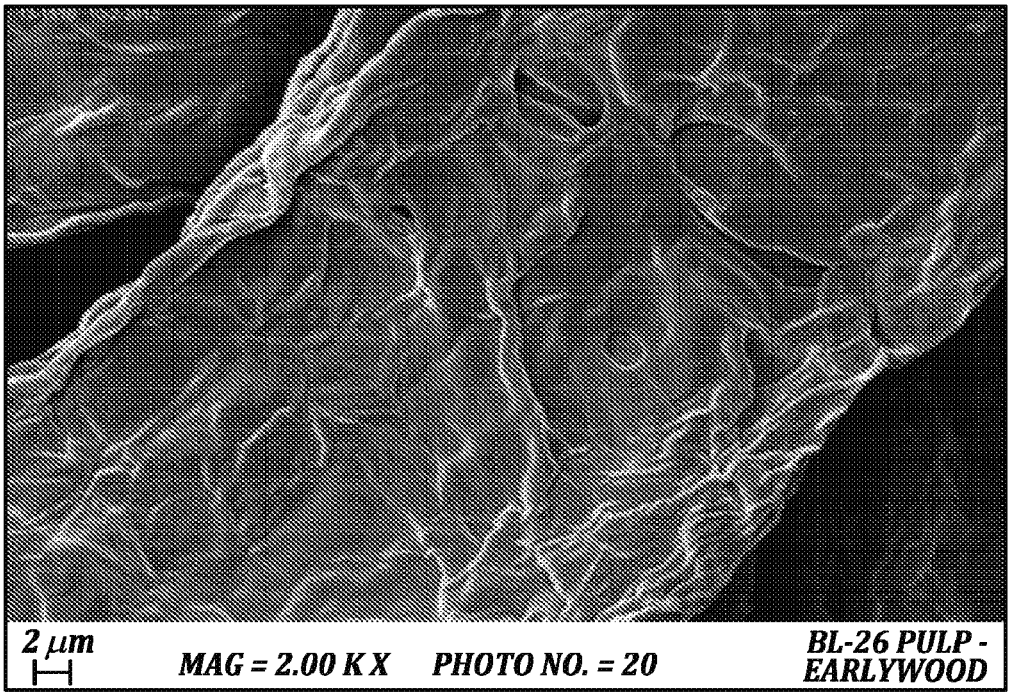
FIG. 5D is a scanning electron micrograph of undissolved earlywood on a filter.

After MRT testing, filters were collected and washed with water several times (adjust to alkaline pH for first water wash) to remove solvents, and the washed filters were air dried for SEM (Scanning electron microscope) examination. Normally there would be some undissolved fibers on the filter and the distribution of the undissolved fibers was generally observed to be uniform. If the distribution of the undissolved fibers was noted to be less uniform, then an area with most undissolved fibers was viewed and photographed at 100×, 500× and 2000× magnification. The photographs at 100× magnification were used to count the total undissolved fibers in the photo area and the fiber count per unit area was calculated. FIG. 5A is a photograph of the filter with many undissolved fiber from testing a commercially available Kraft pulp (GP pulp, sample "competition" in Table 1B). The pulp had low reactivity from other tests and also had low MRT and high undissolved fiber residue after MRT test. FIG. 5B is from an improved Kraft pulp sample A. FIGS. 5A and 5B have the same magnification for easy comparison. Sample B (from Table 1B) had >20 fiber/100 $\mu m^2$ on filter (not shown). FIG. 5C shows the undissolved latewood from control sample (Table 1B) viewed at high magnification (2000 magnification). Latewood appears round, not ribbon like. FIG. 5D is a SEM of an earlywood fiber which appears ribbon like.

While illustrative embodiments have been illustrated and described, it will be appreciated that various changes can be made therein without departing from the spirit and scope of the invention.

Illustrative, non-exclusive examples of embodiments of some compositions and methods in accordance with the scope of the invention are presented in the following numbered paragraphs. The following paragraphs are not intended to be an exhaustive set of embodiments, and are not intended to define minimum or maximum scopes, or required elements or steps, of the invention. Rather, they are provided as illustrative examples of selected compositions and methods that are within the scope of the invention, with other embodiments of broader or narrower scopes, or combinations thereof, not specifically listed herein still being within the scope of the invention.

A. A treated Kraft pulp, including:

a hemicellulose content of 5% or more;

a R18 value of 88% or more; and at least one reactivity value selected from:

a standard reactivity of 3.5 mL or more, a modified reactivity of 30 mL or more, a filter value $K_r$ of 10,000 or less, a SEM fiber segment count of 11 or less per 100 $\mu m^2$ of a filter when the pulp is subjected to a modified reactivity test, and a crystallite cross-section of less than 20.6 $nm^2$;

wherein the treated pulp has less than 8% by weight of cellulose II as determined by x-ray crystallography.

A.1. The treated pulp of paragraph A, wherein the hemicellulose content is greater than 7%.

A.2. The treated pulp of paragraph A or A.1, wherein the R18 value is from 88% to 92%.

A.3. The treated pulp of any of paragraphs A through A.2, wherein the treated pulp has a pentosan content of from 4.6% to 9%.

A.4. The treated pulp of any of paragraphs A through A.3, wherein the treated pulp has a xylan content of 4 to 8%.

A.5. The treated pulp of any of paragraphs A through A.4, wherein the treated pulp has a mannan content of 3% to 8%.

A.6. The treated pulp of any of paragraphs A through A.5, wherein the treated pulp has a standard reactivity of 5 mL or more.

A.7. The treated pulp of any of paragraphs A through A.6, wherein the treated pulp has a modified reactivity of 50 mL or more.

A.8. The treated pulp of any of paragraphs A through A.7, wherein the treated pulp has a filter value $K_r$ of 8,000 or less.

A.9. The treated pulp of any of paragraphs A through A.8, wherein the treated pulp has a carboxyl content of less than 3.6 meq/100 g.

A.10. The treated pulp of any of paragraphs A through A.9, wherein the treated pulp has an ASTM degree of polymerization of from 600 to 900.

A.11. The treated pulp of any of paragraphs A through A.10, wherein the treated pulp has a copper number of from 0.3 to 1.2.

A.12. The treated pulp of any of paragraphs A through A.11, wherein the treated pulp has 0% cellulose II as determined by x-ray crystallography.

A.13. The treated pulp of any of paragraphs A through A.12, wherein the treated pulp has an ageing time of 50 hours or less to reach a target Cuox DP of 340.

A.14. A pulp blend including the treated pulp of any of paragraphs A through A.13 and a dissolving pulp having a R18 of greater than 92%, wherein the pulp blend has a total xylan and mannan content of 6% or more.

A.15. The pulp blend of paragraph A.14, further including a surfactant.

A.16. The pulp blend of paragraph A.14 or A.15, further including a non-ionic surfactant.

A.17. The pulp blend of any of paragraphs A.14 through A.16, wherein the blend includes at least 20% by weight of the treated pulp.

A.18. The pulp blend of any of paragraphs A.14 through A.17, wherein the blend includes at least 30% by weight of the treated pulp.

A.19. The pulp blend of any of paragraphs A.14 through A.18, wherein the blend further includes a filter value $K_r$ of 15,000 or less.

A.20. The pulp blend of any of paragraphs A.14 through A.18, wherein the blend further includes a filter value $K_r$ of 10,000 or less.

A.21. The pulp blend of any of paragraphs A.14 through A.18, wherein the blend further includes a filter value $K_r$ from 3000 to 9000.

A.22. The pulp blend of any of paragraphs A.14 through A.21, wherein the blend has a gamma number of 45.1% or more.

A.23. The pulp blend of any of paragraphs A.14 through A.21, wherein the blend has a gamma number of 46% or more.

A.24. The pulp blend of any of paragraphs A.14 through A.21, wherein the blend has a gamma number of 47% or more.

A.25. The pulp blend of any of paragraphs A.14 through A.24, wherein the blend has an ageing time of 50 hours or less to reach a target Cuox DP of 340.

A.26. A rayon fiber formed from the pulp blend of any of paragraphs A.14 through A.25.

A.27. The rayon fiber of paragraph A.25, wherein the fiber has a hemicellulose content of from 2% to 5%.

B. A pulp blend including:

a treated pulp having a hemicellulose content of 5% or more, a R18 value of 88% or more, and at least one reactivity value selected from:

a standard reactivity of 3.5 mL or more, a modified reactivity of 30 mL or more, a filter value $K_r$ of 10,000 or less, a SEM fiber segment count of 11 or less per 100 $\mu m^2$ of a filter when the pulp is subjected to a modified reactivity test, and a crystallite cross-section of less than 20.6 $nm^2$; and a dissolving pulp having a R18 of greater than 92%;

wherein the pulp blend has a total xylan and mannan content of 6% or more.

B.1. The pulp blend of paragraph B, further including a surfactant.

B.2. A rayon fiber made from the pulp blend of paragraph B or B.1.

C. A method of making the treated pulp of any of paragraphs A through A.13.

D. A method of making the pulp blend of any of paragraphs A.14 through A.27.

D.1. The method of paragraph D, further including the method of paragraph C.

E. A method of making a treated pulp, the method including:

a bleaching sequence that includes the following steps:

exposing a pulp to an oxygen bleaching stage to provide a first delignified pulp;

exposing the first delignified pulp to a first chlorine dioxide bleaching stage to provide a second delignified pulp;

exposing the second delignified pulp to a lignin extraction stage to provide an extracted pulp; and exposing the extracted pulp to a second chlorine dioxide bleaching stage to provide a treated pulp; and at least one of an acid treatment stage and an enzyme treatment stage, each of the at least one of the acid treatment stage and the enzyme treatment stage occurring between the oxygen bleaching stage and the first chlorine dioxide bleaching stage, between the lignin extraction stage and the second chlorine dioxide bleaching stage, or after the second chlorine dioxide stage.

E.1. The method of paragraph E, wherein the acid treatment stage includes using an acid selected from the group consisting of hydrochloric acid, phosphoric acid, sulfuric acid, acetic acid, and nitric acid.

E.2. The method of paragraph E or E.1, wherein the enzyme treatment stage includes using an enzyme selected from the group consisting of xylanase, laccase, pectinase, lipase, peroxidase, mannanase, cellulose, and any combinations thereof.

E.3. The method of any of paragraphs E through E.2, further including a viscosity lowering stage that includes one or more of:

cooking a wood chip to low kappa from 10 to 20, delignifying a cooked pulp to kappa from 3 to 10, bleaching a brownstock at a delignification stage, oxidation using a TEMPO catalyst, oxidation using hypochlorite, and oxidation using chlorine dioxide under alkaline condition, alkaline peroxide, peracid, or any combinations thereof.

E.4. The treated pulp made by the method of any of paragraphs E through E.3.

Although the present invention has been shown and described with reference to the foregoing illustrated embodiments, it will be apparent to those skilled in the art that various changes in form and detail may be made without departing from the spirit and scope of the invention. The present invention is intended to embrace all such alternatives, modifications and variances that fall within the scope of the appended claims.

The invention claimed is:

1. A treated Kraft pulp blend, comprising:

a dissolving pulp; and a treated Kraft pulp, comprising:

a hemicellulose content of 5% or more;

a R18 value of 88% or more; and at least one reactivity value selected from:

a standard reactivity of 3.5 mL or more, a modified reactivity of 30 mL or more, a filter value Kr of 10,000 or less, a SEM fiber segment count of 11 or less per 100 $\mu m^2$ of a filter when the pulp is subjected to a modified reactivity test, and a crystallite cross-section of less than 20.6 $nm^2$;

wherein the treated Kraft pulp has less than 8% by weight of cellulose II as determined by x-ray crystallography;

wherein the treated Kraft pulp blend comprises a gamma number of 50% or less; and wherein the treated Kraft pulp blend comprises at least 20% by weight of the treated Kraft pulp.

2. The treated Kraft pulp blend of claim 1, wherein the hemicellulose content of the treated Kraft pulp is greater than 7%.

3. The treated Kraft pulp blend of claim 1, wherein the R18 of the treated Kraft pulp value is from 88% to 92%.

4. The treated Kraft pulp blend of claim 1, wherein the treated Kraft pulp further comprises one or more of a pentosan content of from 4.6% to 9%, a xylan content of 4% to 8%, and a mannan content of 3% to 8%.

5. The treated Kraft pulp blend of claim 1, wherein the treated Kraft pulp comprises a standard reactivity of 5 mL or more.

6. The treated Kraft pulp blend of claim 1, wherein the treated Kraft pulp comprises a modified reactivity of 50 mL or more.

7. The treated Kraft pulp blend of claim 1, wherein the treated Kraft pulp comprises a filter value Kr of 8,000 or less.

8. The treated Kraft pulp blend of claim 1, wherein the treated Kraft pulp further comprises a carboxyl content of less than 3.6 meq/100g.

9. The treated Kraft pulp blend of claim 1, wherein the treated Kraft pulp further has an ASTM degree of polymerization of from 600 to 900.

10. The treated Kraft pulp blend of claim 1, wherein the treated Kraft pulp further has a copper number of from 0.3 to 1.2.

11. The treated Kraft pulp blend of claim 1, wherein the treated Kraft pulp has 0% cellulose II as determined by x-ray crystallography.

12. The treated Kraft pulp blend of claim 1, wherein the treated Kraft pulp has an ageing time of 50 hours or less to reach a target Cuox DP of 340.

13. The treated Kraft pulp blend of claim 1, wherein the treated Kraft pulp further has a copper number of from 0.2 to 1.6.

14. The treated Kraft pulp blend comprising of claim 1, wherein:

the dissolving pulp has a R18 of greater than 92%; and the blend comprises a total xylan and mannan content of 6% or more.

15. The treated Kraft pulp blend of claim 14, further comprising a surfactant.

16. The treated Kraft pulp blend of claim 14, wherein the blend further comprises a filter value Kr of 15,000 or less.

17. The treated Kraft pulp blend of claim 14, wherein the blend further comprises a gamma number of 45.1% or more.

18. The treated Kraft pulp blend of claim 14 , wherein the blend has an ageing time of 50 hours or less to reach a target Cuox DP of 340.

19. A treated Kraft pulp blend, comprising:

a treated Kraft pulp, comprising:

a hemicellulose content of 5% or more;

a R18 value of 88% or more; and a gamma number of 60% or less; and a dissolving pulp;

wherein the treated Kraft pulp has less than 8% by weight of cellulose II as determined by x-ray crystallography;

wherein the treated Kraft pulp blend comprises a gamma number of 50% or less; and wherein the treated Kraft pulp blend comprises at least 20% by weight of the treated Kraft pulp.

* * * * *